US007423599B2

(12) United States Patent
Li et al.

(10) Patent No.: US 7,423,599 B2
(45) Date of Patent: Sep. 9, 2008

(54) DUAL BAND WLAN ANTENNA

(75) Inventors: James Li, Santa Clara, CA (US); Jing Jiang, San Jose, CA (US)

(73) Assignee: Marvell World Trade Ltd., St. Michael (BB)

( * ) Notice: Subject to any disclaimer, the term of this patent is extended or adjusted under 35 U.S.C. 154(b) by 0 days.

(21) Appl. No.: 11/581,540

(22) Filed: Oct. 16, 2006

(65) Prior Publication Data

US 2007/0182646 A1 Aug. 9, 2007

Related U.S. Application Data

(63) Continuation of application No. 11/519,979, filed on Sep. 12, 2006.

(60) Provisional application No. 60/771,634, filed on Feb. 9, 2006.

(51) Int. Cl.
*H01Q 1/24* (2006.01)

(52) U.S. Cl. ..... 343/702; 343/700 MS

(58) Field of Classification Search ..... 343/702, 343/700 MS, 725, 729, 846, 848
See application file for complete search history.

(56) References Cited

U.S. PATENT DOCUMENTS

| | | | | |
|---|---|---|---|---|
| 4,343,976 | A | 8/1982 | Nasretdin et al. | |
| 5,714,961 | A * | 2/1998 | Kot et al. | 343/769 |
| 6,184,828 | B1 * | 2/2001 | Shoki | 342/372 |
| 6,597,316 | B2 * | 7/2003 | Rao et al. | 343/700 MS |
| 7,006,043 | B1 | 2/2006 | Nalbandian | |
| 2002/0163473 | A1 * | 11/2002 | Koyama et al. | 343/718 |
| 2003/0210187 | A1 | 11/2003 | Lu et al. | |
| 2004/0004572 | A1 | 1/2004 | Ma | |
| 2004/0239568 | A1 | 12/2004 | Masutani | |
| 2005/0062652 | A1 * | 3/2005 | Huang | 343/700 MS |

(Continued)

FOREIGN PATENT DOCUMENTS

EP 0 795 926 A2 9/1997

(Continued)

OTHER PUBLICATIONS

IEEE Std 802.11a-1999 (Supplement to IEEE Std 802.11-1999) [Adopted by ISO/IEC and redesignated as ISO/IEC 8802-11: 1999/Amd 1:2000(E)]; Supplement to IEEE Standard for Information technology—Telecommunications and information exchange between systems—Local and metropolitan area networks—Specific requirements—Part 11: Wireless LAN Medium Access Control (MAC) and Physical Layer (PHY) specifications High-speed Physical Layer in the 5 GHz Band; LAN/MAN Standards Committee of the IEEE Computer Society; 91 pages.

(Continued)

*Primary Examiner*—HoangAnh T Le

(57) ABSTRACT

An antenna system comprises a first antenna that is arranged on a printed circuit board (PCB) and that includes an arc-shaped element having a concave side and a convex side. A conducting element extends substantially radially from a center of the concave side. A U-shaped element has a base portion with a center that communicates with the conducting element and two side portions that extend from ends of the base portion towards the concave side. Second and third antennas are arranged on the PCB and include an inner ring and an outer ring that is concentric to the inner ring.

42 Claims, 38 Drawing Sheets

U.S. PATENT DOCUMENTS

2005/0140551 A1 6/2005 Kaluzni et al.

FOREIGN PATENT DOCUMENTS

WO WO02/49153 A1 6/2002
WO WO2005/062422 7/2005

OTHER PUBLICATIONS

IEEE Std 802.11b-1999 (Supplement to IEEE Std 802.11-1999 Edition); Supplement to IEEE Standard for Information technology—Telecommunications and information exchange between systems—Local and metropolitan area networks—Specific requirements—Part 11: Wireless LAN Medium Access Control (MAC) and Physical Layer (PHY) specifications: Higher-Speed Physical Layer Extension in the 2.4 GHz Band; LAN/MAN Standards Committee of the IEEE Computer Society; Sep. 16, 1999 IEEE-SA Standards Board; 96 pages.

IEEE P802.11g/D8.2, Apr. 2003 (Supplement to ANSI/IEEE Std 802.11-1999(Reaff 2003)); Draft Supplement to Standard [for] Information Technology—Telecommunications and information exchange between systems—Local and metropolitan area networks—Specific requirements—Part 11: Wireless LAN Medium Access Control (MAC) and Physical Layer (PHY) specifications: Further Higher Data Rate Extension in the 2.4 GHz Band; LAN/MAN Standards Committee of the IEEE Computer Society; 69 pages.

802.11n; IEEE P802.11-04/0889r6; Wireless LANs, TGn Sync Proposal Technical Specification; 131 pages.

IEEE Std 802.16-2004 (Revision of IEEE Std 802.16-2001) IEE Standard for Local and metropolitan area networks; Part 16: Air Interface for Fixed Broadband Wireless Access Systems; IEEE Computer Society and the IEEE Microwave Theory and Techniquest Society; Oct. 1, 2004; 893 pages.

R. J. Langley et al.: "Annual Ring Patch Antennas", IEE Colloqium on Multi-Band Antennas, Digest No. 181, 1992, pp. 6-1, XP006521400, London.

Saha (Misra) et al.: "Experiment on Impedance and Radiation Properties of Concentric Microstrip Ring Resonators"; Electronic Letters, IEE Stevenage, GB, vol. 31, No. 6, Mar. 16, 1995, pp. 421-422, XP006002559, ISSN: 0013-5194.

J.C. Liu et al.: "Double-Ring Active Microstrip Antenna and Self-Mixing Oscillator in C-Band", IEE Proceedings H. Microwaves, Antennas & Propagation, Institution of Electrical Engineers, Stevenage, GB, vol. 147, No. 6, Dec. 8, 2000, pp. 479-482, XP006014311, ISSN: 0950-107X.

PCT Notification of the International Search Report and The Written Opinion of The International Searching Authority, or The Declaration; PCT/US2007/003594; dated Nov. 5, 2007; 24 pgs.

* cited by examiner

DUAL BAND WLAN ANTENNA

CROSS-REFERENCE TO RELATED APPLICATIONS

This application is a Continuation of U.S. patent application Ser. No. 11/519,979 filed on Sep. 12, 2006 which claims the benefit of U.S. Provisional Application No. 60/771,634, filed on Feb. 9, 2006. The disclosures of the above applications are incorporated herein by reference in their entirety.

FIELD

The present disclosure relates to wireless communication systems, and more particularly to antennas for wireless network devices.

BACKGROUND

The background description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present disclosure.

The I.E.E.E. standards 802.11a, 802.11b, 802.11g, 802.11n, and 802.16, which are incorporated herein by reference in their entirety, define ways for configuring wireless networks and wireless devices such as client stations and access points. Referring now to FIGS. 1A-1B, a wireless network device may operate in either an ad-hoc mode or an infrastructure mode. In the ad-hoc mode, which is shown in FIG. 1A, each client station 10-1, 10-2, . . . , and 10-N (collectively client stations 10) communicates directly with other client stations.

In the infrastructure mode, which is shown in FIG. 1B, each client station 20-1, 20-2, . . . , and 20-M (collectively client stations 20) communicates with other client stations through an access point (AP) 24. The AP 24 may provide a connection to a network 26, a server 28, and the Internet 30.

Referring now to FIG. 1C, client stations and APs generally include a processor 42, a medium access controller (MAC) device 44, a baseband processor (BBP) 46, and a radio frequency (RF) transceiver 48. The RF transceiver 48 transmits and receives signals through the antenna 49.

Range and throughput (i.e., data rate) of wireless devices may vary depending on environmental conditions. For example, the throughput may decrease as distance and obstructions between a client station and an AP increase. Range and throughput may be increased by using multiple antennas for data transmission and reception.

Some wireless devices use multiple antennas in diversity configurations. In diversity configurations, however, only one antenna is utilized at a time for communication. Consequently, only one set of circuits comprising a RF transceiver, a BBP, etc., is generally used for signal processing. Thus, effective increase in throughput may be marginal.

Alternatively, more than one antenna can be utilized when multiple antennas are used in multiple-input multiple-output (MIMO) configurations. That is, multiple antennas can be utilized simultaneously in MIMO configurations. Specifically, data streams can be transmitted and received through multiple antennas simultaneously. A separate circuit comprising one RF transceiver, one BBP, etc., may be used to process each data stream. That is, an independent set of RF transceivers, BBP, etc., may be used to process data streams associated with each antenna. Thus, antennas may yield higher throughputs in MIMO configurations than in diversity configurations.

MIMO configurations are generally expressed as T×R, where T and R denote number of transmit and receive antennas, respectively. Data streams may be affected by relative locations of transmitting and receiving antennas. By aligning transmitting and receiving antennas relative to one another, a receiver can identify transmissions of each transmitting antenna of a transmitter.

Wireless devices may use different types of antennas. For example, 802.11a-compliant wireless devices use single band antennas of 2.4 GHz bandwidth. 802.11g-compliant wireless devices may use single band antennas of 5 GHz bandwidth. Additionally, 802.11g-compliant wireless devices may use dual band antennas that enable communication in 2.4GHz and 5 GHz frequency bands since 802.11g-compliant devices are 802.11a-compatible. Similarly, 802.11n-compliant wireless devices may use dual band antennas that enable the wireless devices to communicate in 2.4 GHz and 5 GHz frequency bands.

SUMMARY

An antenna system comprises first, second, and third antennas that are arranged on a printed circuit board (PCB) and that include an arc-shaped element having a concave side and a convex side and a conducting element that extends substantially radially from a center of the concave side.

In another feature, the convex side radiates electromagnetic radiation.

In another feature, the first, second, and third antennas communicate in a single frequency band in a 3×3 multiple input multiple output (MIMO) configuration.

In another feature, the first, second, and third antennas communicate in a 2.4 GHz frequency band in a 3×3 multiple input multiple output (MIMO) configuration.

In another feature, the first, second, and third antennas are printed on the PCB.

In another feature, the convex side of the first antenna is adjacent to a first edge of the PCB. The convex side of the second antenna is adjacent to a second edge of the PCB, wherein the second edge is opposite and substantially parallel to the first edge, and wherein tangents drawn at centers of the convex sides of the first and second antennas are substantially parallel to each other. The convex side of the third antenna is adjacent to a third edge of the PCB, wherein a tangent drawn at a center of the convex side of the third antenna is substantially perpendicular to the tangents and the first and second edges.

In another feature, the conducting elements of the first and second antennas are substantially collinear and extend towards each other. The conducting element of the third antenna extends substantially perpendicularly towards a line joining the conducting elements of the first and second antennas.

In another feature, the concave sides of the first and second antennas face each other. The conducting elements of the first and second antennas are substantially collinear and extend towards each other. The concave side of the third antenna faces a line joining the conducting elements of the first and second antennas. The conducting element of the third antenna extends substantially perpendicularly towards the line.

In another feature, the conducting elements of the first, second, and third antennas communicate with respective radio frequency (RF) transceivers.

In another feature, each of the first, second, and third antennas further includes a U-shaped element having a base portion with a center that communicates with the conducting element and two side portions that extend from ends of the base portion towards the concave side.

In another feature, the two side portions and the conducting element are substantially parallel to each other and substantially perpendicular to the base portion.

In another feature, the convex side of the arc-shaped element radiates electromagnetic radiation and the U-shaped element directs the electromagnetic radiation.

In another feature, the first, second, and third antennas communicate in a dual frequency band in a 3×3 multiple input multiple output (MIMO) configuration.

In another feature, the first, second, and third antennas communicate in 2.4 GHz and 5 GHz frequency bands in a 3×3 multiple input multiple output (MIMO) configuration.

In another feature, the arc-shaped element communicates in a 2.4 GHz frequency band and the U-shaped element communicates in a 5 GHz frequency band.

In another feature, the PCB comprises a first electrically conducting layer that is adjacent to a first surface of the PCB and a second electrically conducting layer that is adjacent to a second surface of the PCB, and wherein the first surface is opposite to the second surface.

In another feature, the first electrically conducting layer and the first, second, and third antennas are printed on the first surface, and wherein the first electrically conducting layer is not joined to the first, second, and third antennas.

In another feature, the first electrically conducting layer communicates with the second electrically conducting layer via through-holes.

In another feature, the first and second electrically conducting layers include copper.

In another feature, a wireless network device comprises the antenna system.

In another feature, a device comprises the antenna system wherein the device is compliant with Worldwide Interoperability for Microwave Access (WiMAX) standard.

In another feature, a wireless network device comprises the antenna system wherein the wireless network device operates in a wireless fidelity local area network and complies with at least one of IEEE 802.11a, 802.11b, 802.11g, 802.11n, and 802.16 standards.

In another feature, a cellular phone comprises the antenna system.

In still other features, a method comprises arranging an arc-shaped element of each of first, second, and third antennas on a printed circuit board (PCB), wherein the arc-shaped element has a concave side and a convex side. The method further comprises extending a conducting element of each of the first, second, and third antennas substantially radially from a center of the concave side of the arc-shaped element of each of the first, second, and third antennas on the PCB, respectively.

In another feature, the method further comprises radiating electromagnetic radiation from the convex side of the arc-shaped element of at least one of the first, second, and third antennas.

In another feature, the method further comprises configuring the first, second, and third antennas in a 3×3 multiple input multiple output (MIMO) configuration and communicating in a single frequency band.

In another feature, the method further comprises configuring the first, second, and third antennas in a 3×3 multiple input multiple output (MIMO) configuration and communicating in a 2.4 GHz frequency band.

In another feature, the method further comprises printing the first, second, and third antennas on the PCB.

In another feature, the method further comprises arranging the convex side of the first antenna adjacent to a first edge of the PCB. The method further comprises arranging the convex side of the second antenna adjacent to a second edge of the PCB, wherein tangents drawn at centers of the convex sides of the first and second antennas are substantially parallel to each other. The method further comprises arranging the first and second edges substantially parallel and opposite to each other. The method further comprise arranging the convex side of the third antenna adjacent to a third edge of the PCB, wherein a tangent drawn at a center of the convex side of the third antenna is substantially perpendicular to the tangents and said first and second edges.

In another feature, the method further comprises extending the conducting elements of the first and second antennas towards each other, arranging the conducting elements of the first and second antennas substantially collinear with each other, and extending the conducting element of the third antenna substantially perpendicularly towards a line joining the conducting elements of the first and second antennas.

In another feature, the method further comprises arranging the concave sides of the first and second antennas facing towards each other. The method further comprises extending the conducting elements of the first and second antennas towards each other. The method further comprises arranging the conducting elements of the first and second antennas substantially collinear with each other. The method further comprises arranging the concave side of the third antenna facing towards a line joining the conducting elements of the first and second antennas. The method further comprises extending the conducting element of the third antenna substantially perpendicularly towards the line.

In another feature, the method further comprises communicating between the conducting elements of the first, second, and third antennas and respective radio frequency (RF) transceivers.

In another feature, the method further comprises arranging a base portion of a U-shaped element of each of the first, second, and third antennas on the PCB, communicating between a center of the base portion and the conducting element, and extending two side portions of the U-shaped element from ends of the base portion towards the concave side.

In another feature, the method further comprises arranging the two side portions and the conducting element substantially parallel to each other and substantially perpendicular to the base portion on the PCB.

In another feature, the method further comprises radiating electromagnetic radiation from the convex side of the arc-shaped element and directing the electromagnetic radiation with the U-shaped element.

In another feature, the method further comprises configuring the first, second, and third antennas in a 3×3 multiple input multiple output (MIMO) configuration and communicating in a dual frequency band.

In another feature, the method further comprises configuring the first, second, and third antennas in a 3×3 multiple input multiple output (MIMO) configuration and communicating in 2.4 GHz and 5 GHz frequency bands.

In another feature, the method further comprises communicating in a 2.4 GHz frequency band with the arc-shaped element and communicating in a 5 GHz frequency band with the U-shaped element.

In another feature, the method further comprises arranging a first electrically conducting layer adjacent to a first surface of the PCB, arranging a second surface of the PCB opposite to the first surface, and arranging a second electrically conducting layer adjacent to a second surface of the PCB.

In another feature, the method further comprises printing the first electrically conducting layer and the first, second, and third antennas on the first surface, and not joining the first electrically conducting layer to the first, second, and third antennas.

In another feature, the method further comprises communicating between the first and second electrically conducting layers.

In another feature, the method further comprises providing copper in the first and second electrically conducting layers.

In still other features, an antenna system comprises first, second, and third antenna means for communicating radio frequency (RF) signals, wherein each of the first, second, and third antenna means is arranged on a printed circuit board (PCB) and includes arc-shaped means for communicating the RF signals, wherein the arc-shaped means has a concave side and a convex side. Each of the first, second, and third antenna means includes conducting means for communicating with the arc-shaped means, wherein the conducting means extends substantially radially from a center of the concave side.

In another feature, the convex side radiates electromagnetic radiation.

In another feature, the first, second, and third antenna means communicate in a single frequency band in a 3×3 multiple input multiple output (MIMO) configuration.

In another feature, the first, second, and third antenna means communicate in a 2.4 GHz frequency band in a 3×3 multiple input multiple output (MIMO) configuration.

In another feature, the first, second, and third antenna means are printed on the PCB.

In another feature, the convex side of the first antenna means is adjacent to a first edge of the PCB. The convex side of the second antenna means is adjacent to a second edge of the PCB, wherein the second edge is opposite and substantially parallel to the first edge, and wherein tangents drawn at centers of the convex sides of the first and second antenna means are substantially parallel to each other. The convex side of the third antenna means is adjacent to a third edge of the PCB, wherein a tangent drawn at a center of the convex side of the third antenna means is substantially perpendicular to the tangents and the first and second edges.

In another feature, the conducting means of the first and second antenna means are substantially collinear and extend towards each other. The conducting means of the third antenna means extends substantially perpendicularly towards a line joining the conducting means of the first and second antenna means.

In another feature, the concave sides of the first and second antenna means face each other. The conducting means of the first and second antenna means are substantially collinear and extend towards each other. The concave side of the third antenna means faces a line joining the conducting means of the first and second antenna means. The conducting means of the third antenna means extends substantially perpendicularly towards the line.

In another feature, the conducting means of the first, second, and third antenna means communicate with respective radio frequency (RF) transceivers.

In another feature, each of the first, second, and third antenna means further includes U-shaped means for communicating the RF signals, wherein the U-shaped means has a base portion with a center that communicates with the conducting means and two side portions that extend from ends of the base portion towards the concave side.

In another feature, the two side portions and the conducting means are substantially parallel to each other and substantially perpendicular to the base portion.

In another feature, the convex side of the arc-shaped means radiates electromagnetic radiation and the U-shaped means directs the electromagnetic radiation.

In another feature, the first, second, and third antenna means communicate in a dual frequency band in a 3×3 multiple input multiple output (MIMO) configuration.

In another feature, the first, second, and third antenna means communicate in 2.4 GHz and 5 GHz frequency bands in a 3×3 multiple input multiple output (MIMO) configuration.

In another feature, the arc-shaped means communicates in a 2.4 GHz frequency band and the U-shaped means communicates in a 5 GHz frequency band.

In another feature, the PCB comprises first and second layers of electrically conducting means for communicating with the first, second, and third antenna means, and wherein the first layer is adjacent to a first surface of the PCB and the second layer is adjacent to a second surface of the PCB, and wherein the first surface is opposite to the second surface.

In another feature, the first layer and the first, second, and third antenna means are printed on the first surface, and wherein the first layer is not joined to the first, second, and third antenna means.

In another feature, the antenna system further comprises through-hole means for communicating between the first and second layers.

In another feature, the electrically conducting means includes copper.

In another feature, a wireless network device comprises the antenna system.

In another feature, a device comprises the antenna system wherein the device is compliant with Worldwide Interoperability for Microwave Access (WiMAX) standard.

In another feature, a wireless network device comprises the antenna system wherein the wireless network device operates in a wireless fidelity local area network and complies with at least one of IEEE 802.11a, 802.11b, 802.11g, 802.11n, and 802.16 standards.

In another feature, a cellular phone comprises the antenna system.

In still other features, an antenna system comprises first, second, and third antennas that are arranged on a printed circuit board (PCB) and that include an arc-shaped element having a concave side and a convex side and a conducting element that extends substantially radially from a center of the concave side. The first, second, and third antennas include a U-shaped element having a base portion with a center that communicates with the conducting element and two side portions that extend from ends of the base portion towards the concave side.

In another feature, the two side portions and the conducting element are substantially parallel to each other and substantially perpendicular to the base portion.

In another feature, the convex side of the arc-shaped element radiates electromagnetic radiation and the U-shaped element directs the electromagnetic radiation.

In another feature, the first, second, and third antennas communicate in a dual frequency band in a 3×3 multiple input multiple output (MIMO) configuration.

In another feature, the first, second, and third antennas communicate in 2.4 GHz and 5 GHz frequency bands in a 3×3 multiple input multiple output (MIMO) configuration.

In another feature, the arc-shaped element communicates in a 2.4 GHz frequency band and the U-shaped element communicates in a 5 GHz frequency band.

In another feature, the first, second, and third antennas are printed on the PCB.

In another feature, the convex side of the first antenna is adjacent to a first edge of the PCB. The convex side of the second antenna is adjacent to a second edge of the PCB, wherein the second edge is opposite and substantially parallel to the first edge, and wherein tangents drawn at centers of the convex sides of the first and second antennas are substantially parallel to each other. The convex side of the third antenna is adjacent to a third edge of the PCB, wherein a tangent drawn at a center of the convex side of the third antenna is substantially perpendicular to the tangents and the first and second edges.

In another feature, the conducting elements of the first and second antennas are substantially collinear and extend towards each other. The conducting element of the third antenna extends substantially perpendicularly towards a line joining the conducting elements of the first and second antennas.

In another feature, the concave sides of the first and second antennas face each other. The conducting elements of the first and second antennas are substantially collinear and extend towards each other. The concave side of the third antenna faces a line joining the conducting elements of the first and second antennas. The conducting element of the third antenna extends substantially perpendicularly towards the line.

In another feature, the conducting elements of the first, second, and third antennas communicate with respective radio frequency (RF) transceivers.

In another feature, the PCB comprises a first electrically conducting layer that is adjacent to a first surface of the PCB and a second electrically conducting layer that is adjacent to a conducting surface of the PCB, and wherein the first surface is opposite to the conducting surface.

In another feature, the first electrically conducting layer and the first, second, and third antennas are printed on the first surface, and wherein the first electrically conducting layer is not joined to the first, second, and third antennas.

In another feature, the first electrically conducting layer communicates with the second electrically conducting layer via through-holes.

In another feature, the first and second electrically conducting layers include copper.

In another feature, a wireless network device comprises the antenna system.

In another feature, a device comprises the antenna system wherein the device is compliant with Worldwide Interoperability for Microwave Access (WiMAX) standard.

In another feature, a wireless network device comprises the antenna system wherein the wireless network device operates in a wireless fidelity local area network and complies with at least one of IEEE 802.11a, 802.11b, 802.11g, 802.11n, and 802.16 standards.

In another feature, a cellular phone comprises the antenna system.

Instill other features, a method comprises arranging an arc-shaped element of each of first, second, and third antennas on a printed circuit board (PCB), wherein the arc-shaped element has a concave side and a convex side. The method further comprises extending a conducting element of each of the first, second, and third antennas substantially radially from a center of the concave side of the arc-shaped element of each of the first, second, and third antennas on the PCB, respectively. The method further comprises arranging a base portion of a U-shaped element of each one the first, second, and third antennas on the PCB. The method further comprises communicating between a center of the base portion and the conducting element. The method further comprises extending two side portions of the U-shaped element from ends of the base portion towards the concave side on the PCB.

In another feature, the method further comprises arranging the two side portions and the conducting element substantially parallel to each other and substantially perpendicular to the base portion on the PCB.

In another feature, the method further comprises radiating electromagnetic radiation from the convex side of the arc-shaped element and directing the electromagnetic radiation with the U-shaped element.

In another feature, the method further comprises configuring the first, second, and third antennas in a 3×3 multiple input multiple output (MIMO) configuration and communicating in a dual frequency band.

In another feature, the method further comprises configuring the first, second, and third antennas in a 3×3 multiple input multiple output (MIMO) configuration and communicating in 2.4 GHz and 5 GHz frequency bands.

In another feature, the method further comprises communicating in a 2.4 GHz frequency band with the arc-shaped element and communicating in a 5 GHz frequency band with the U-shaped element.

In another feature, the method further comprises printing the first, second, and third antennas on the PCB.

In another feature, the method further comprises arranging the convex side of the first antenna adjacent to a first edge of the PCB and arranging the convex side of the second antenna adjacent to a second edge of the PCB, wherein tangents drawn at centers of the convex sides of the first and second antennas are substantially parallel to each other. The method further comprises arranging the first and second edges substantially parallel and opposite to each other. The method further comprises arranging the convex side of the third antenna adjacent to a third edge of the PCB, wherein a tangent drawn at a center of the convex side of the third antenna is substantially perpendicular to the tangents and said first and second edges.

In another feature, the method further comprises extending the conducting elements of the first and second antennas towards each other, arranging the conducting elements of the first and second antennas substantially collinear with each other, and extending the conducting element of the third antenna substantially perpendicularly towards a line joining the conducting elements of the first and second antennas.

In another feature, the method further comprises arranging the concave sides of the first and second antennas facing towards each other, and extending the conducting elements of the first and second antennas towards each other. The method further comprises arranging the conducting elements of the first and second antennas substantially collinear with each other. The method further comprises arranging the concave side of the third antenna facing towards a line joining the conducting elements of the first and second antennas. The method further comprises extending the conducting element of the third antenna substantially perpendicularly towards the line.

In another feature, the method further comprises communicating between the conducting elements of the first, second, and third antennas and respective radio frequency (RF) transceivers.

In another feature, the method further comprises arranging a first electrically conducting layer adjacent to a first surface of the PCB, arranging a second surface of the PCB opposite to the first surface, and arranging a second electrically conducting layer adjacent to a second surface of the PCB.

In another feature, the method further comprises printing the first electrically conducting layer and the first, second, and third antennas on the first surface, and not joining the first electrically conducting layer to the first, second, and third antennas.

In another feature, the method further comprises communicating between the first and second electrically conducting layers.

In another feature, the method further comprises providing copper in the first and second electrically conducting layers.

In still other features, an antenna system comprises first, second, and third antenna means for communicating radio frequency (RF) signals, wherein each of the first, second, and third antenna means is arranged on a printed circuit board (PCB) and includes arc-shaped means for communicating the RF signals, wherein the arc-shaped means has a concave side and a convex side. Each of the first, second, and third antenna means includes conducting means for communicating with the arc-shaped means, wherein the conducting means extends substantially radially from a center of the concave side. Each of the first, second, and third antenna means includes U-shaped means for communicating the RF signals, wherein the U-shaped means has a base portion with a center that communicates with the conducting means and two side portions that extend from ends of the base portion towards the concave side.

In another feature, the two side portions and the conducting means are substantially parallel to each other and substantially perpendicular to the base portion.

In another feature, the convex side of the arc-shaped means radiates electromagnetic radiation and the U-shaped means directs the electromagnetic radiation.

In another feature, the first, second, and third antenna means communicates in a dual frequency band in a 3×3 multiple input multiple output (MIMO) configuration.

In another feature, the first, second, and third antenna means communicate in 2.4 GHz and 5 GHz frequency bands in a 3×3 multiple input multiple output (MIMO) configuration.

In another feature, the arc-shaped means communicates in a 2.4 GHz frequency band and the U-shaped means communicates in a 5 GHz frequency band.

In another feature, the first, second, and third antenna means are printed on the PCB.

In another feature, the convex side of the first antenna means is adjacent to a first edge of the PCB. The convex side of the second antenna means is adjacent to a second edge of the PCB, wherein the second edge is opposite and substantially parallel to the first edge, and wherein tangents drawn at centers of the convex sides of the first and second antenna means are substantially parallel to each other. The convex side of the third antenna means is adjacent to a third edge of the PCB, wherein a tangent drawn at a center of the convex side of the third antenna is substantially perpendicular to the tangents and the first and second edges.

In another feature, the conducting means of the first and second antenna means are substantially collinear and extend towards each other. The conducting means of the third antenna means extends substantially perpendicularly towards a line joining the conducting means of the first and second antenna means.

In another feature, the concave sides of the first and second antenna means face each other. The conducting means of the first and second antenna means are substantially collinear and extend towards each other. The concave side of the third antenna means faces a line joining the conducting means of the first and second antenna means. The conducting means of the third antenna means extends substantially perpendicularly towards the line.

In another feature, the conducting means of each of the first, second, and third antenna means communicates with respective radio frequency (RF) transceivers.

In another feature, the PCB comprises first and second layers of electrically conducting means for communicating with the first, second, and third antenna means, and wherein the first layer is adjacent to a first surface of the PCB and the second layer is adjacent to a second surface of the PCB, and wherein the first surface is opposite to the second surface.

In another feature, the first layer and the first, second, and third antenna means are printed on the first surface, and wherein the first layer is not joined to the first, second, and third antenna means.

In another feature, the antenna system further comprises through-hole means for communicating between the first and second layers.

In another feature, the electrically conducting means includes copper.

In another feature, a wireless network device comprises the antenna system.

In another feature, a device comprises the antenna system wherein the device is compliant with Worldwide Interoperability for Microwave Access (WiMAX) standard.

In another feature, a wireless network device comprises the antenna system of wherein the wireless network device operates in a wireless fidelity local area network and complies with at least one of IEEE 802.11a, 802.11b, 802.11g, 802.11n, and 802.16 standards.

In another feature, a cellular phone comprises the antenna system.

In still other features, an antenna system comprises a first antenna that is arranged on a printed circuit board (PCB) and that includes an arc-shaped element having a concave side and a convex side and a conducting element that extends substantially radially from a center of the concave side. The first antenna includes a U-shaped element having a base portion with a center that communicates with the conducting element and two side portions that extend from ends of the base portion towards the concave side. The antenna system further includes second and third antennas that are arranged on the PCB and that include an inner ring and an outer ring that is concentric to the inner ring.

In another feature, the two side portions and the conducting element are substantially parallel to each other and substantially perpendicular to the base portion.

In another feature, the inner ring has a greater ring width than the outer ring, and wherein the ring width is a radial distance between an inner circumference and an outer circumference of each of the inner ring and the outer ring.

In another feature, the inner ring communicates with the outer ring.

In another feature, the concave side faces the second and third antennas. The center of the concave side and centers of the inner and outer rings of the second and third antennas constitute vertices of a triangle. The conducting element is substantially perpendicular to a line joining the centers. The conducting element extends towards a mid-point of the line.

In another feature, the triangle is one of an isosceles triangle and an equilateral triangle.

In another feature, the convex side radiates electromagnetic radiation and the U-shaped element directs the electromagnetic radiation.

In another feature, the first, second, and third antennas communicate in a dual frequency band in a 3×3 multiple input multiple output (MIMO) configuration.

In another feature, the first, second, and third antennas communicate in 2.4 GHz and 5 GHz frequency bands in a 3×3 multiple input multiple output (MIMO) configuration.

In another feature, the arc-shaped element communicates in a 2.4 GHz frequency band and the U-shaped element communicates in a 5 GHz frequency band.

In another feature, the inner ring communicates in a 5 GHz frequency band and the outer ring communicates in a 2.4 GHz frequency band.

In another feature, the first antenna is printed on the PCB. The second and third antennas are mounted on the PCB.

In another feature, the conducting element of the first antenna communicates with a radio frequency (RF) transceiver. The second and third antennas communicate with respective radio frequency (RF) transceivers.

In another feature, the PCB comprises a first electrically conducting layer that is adjacent to a first surface of the PCB and a second electrically conducting layer that is adjacent to a second surface of the PCB, and wherein the first surface is opposite to the second surface.

In another feature, the first electrically conducting layer and the first antenna are printed on the first surface, and wherein the first electrically conducting layer is not joined to the first antenna.

In another feature, the second and third antennas are mounted on the first electrically conducting layer, and wherein the inner rings of the second and third antennas communicate with the first electrically conducting layer.

In another feature, the first electrically conducting layer communicates with the second electrically conducting layer via through-holes.

In another feature, the first and second electrically conducting layers include copper.

In another feature, a wireless network device comprises the antenna system.

In another feature, a device comprises the antenna system wherein the device is compliant with Worldwide Interoperability for Microwave Access (WiMAX) standard.

In another feature, a wireless network device comprises the antenna system wherein the wireless network device operates in a wireless fidelity local area network and complies with at least one of IEEE 802.11a, 802.11b, 802.11g, 802.11n, and 802.16 standards.

In another feature, a cellular phone comprises the antenna system.

In still other features, a method comprises arranging an arc-shaped element of a first antenna on a printed circuit board (PCB), wherein the arc-shaped element has a concave side and a convex side, and extending a conducting element of the first antenna substantially radially from a center of the concave side on the PCB. The method further comprises arranging a base portion of a U-shaped element of the first antenna on the PCB, communicating between a center of the base portion and the conducting element, and extending two side portions of the U-shaped element from ends of the base portion towards the concave side. The method further comprises arranging an inner ring of each of second and third antennas concentrically with an outer ring of each of the second and third antennas on the PCB, respectively.

In another feature, the method further comprises arranging the two side portions and the conducting element substantially perpendicular to the base portion on the PCB.

In another feature, the method further comprises communicating between the inner and outer rings, wherein the inner ring has a greater ring width than the outer ring, and wherein the ring width is a radial distance between an inner circumference and an outer circumference of each of the inner ring and the outer ring.

In another feature, the method further comprises arranging the concave side facing the second and third antennas. The method further comprises arranging the center of the concave side and centers of the inner and outer rings of the second and third antennas at vertices of a triangle, wherein the triangle is one of an isosceles triangle and an equilateral triangle. The method further comprises arranging the conducting element substantially perpendicular to a line joining the centers. The method further comprises extending the conducting element towards a mid-point of the line.

In another feature, the method further comprises radiating electromagnetic radiation from the convex side of the arc-shaped element and directing the electromagnetic radiation with the U-shaped element.

In another feature, the method further comprises configuring the first, second, and third antennas in a 3×3 multiple input multiple output (MIMO) configuration and communicating in a dual frequency band.

In another feature, the method further comprises configuring the first, second, and third antennas in a 3×3 multiple input multiple output (MIMO) configuration and communicating in 2.4 GHz and 5 GHz frequency bands.

In another feature, the method further comprises communicating in a 2.4 GHz frequency band with the arc-shaped element and communicating in a 5 GHz frequency band with the U-shaped element.

In another feature, the method further comprises communicating in a 2.4 GHz frequency band with the outer ring and communicating in a 5 GHz frequency band with the inner ring.

In another feature, the method further comprises printing the first antenna on the PCB. The method further comprises mounting the second and third antennas on the PCB.

In another feature, the method further comprises communicating between the conducting element of the first antenna and a radio frequency (RF) transceivers. The method further comprises communicating between the second and third antennas and respective radio frequency (RF) transceivers.

In another feature, the method further comprises arranging a first electrically conducting layer adjacent to a first surface of the PCB, arranging a second surface of the PCB opposite to the first surface, and arranging a second electrically conducting layer adjacent to a second surface of the PCB.

In another feature, the method further comprises printing the first electrically conducting layer and the first antenna on the first surface, and not joining the first electrically conducting layer to the first antenna.

In another feature, the method further comprises mounting the second and third antennas on the first electrically conducting layer, and communicating between the first electrically conducting layer and the inner rings of the second and third antennas.

In another feature, the method further comprises communicating between the first and second electrically conducting layers.

In another feature, the method further comprises providing copper in the first and second electrically conducting layers.

In still other features, an antenna system comprises first antenna means for communicating radio frequency (RF) signals, wherein the first antenna means is arranged on a printed circuit board (PCB). The first antenna means includes arc-shaped means for communicating the RF signals, wherein the arc-shaped means has a concave side and a convex side and conducting means for communicating with the arc-shaped means, wherein the conducting means extends substantially radially from a center of the concave side. The first antenna means includes and U-shaped means for communicating the RF signals, wherein the U-shaped means has a base portion with a center that communicates with the conducting means and two side portions that extend from ends of the base portion towards the concave side. The antenna system further comprises second and third antenna means for communicating the RF signals, wherein each of the second and third antenna means is arranged on the PCB and includes inner ring means for communicating the RF signals and outer ring means for communicating the RF signals, and wherein the inner and outer ring means are concentric.

In another feature, the two side portions and the conducting means are substantially parallel to each other and substantially perpendicular to the base portion.

In another feature, the inner ring means has a greater ring width than the outer ring means, and wherein the ring width is a radial distance between an inner circumference and an outer circumference of each of the inner and outer ring means.

In another feature, the inner ring means communicates with the outer ring means.

in another feature, the concave side faces the second and third antenna means. The center of the concave side and centers of the inner and outer rings of the second and third antenna means constitute vertices of a triangle. The conducting means is substantially perpendicular to a line joining the centers. The conducting means extends towards a mid-point of the line.

In another feature, the triangle is one of an isosceles triangle and an equilateral triangle.

In another feature, the convex side radiates electromagnetic radiation and the U-shaped means directs the electromagnetic radiation.

In another feature, the first, second, and third antenna means communicate in a dual frequency band in a 3×3 multiple input multiple output (MIMO) configuration.

In another feature, the first, second, and third antenna means communicate in 2.4 GHz and 5 GHz frequency bands in a 3×3 multiple input multiple output (MIMO) configuration.

In another feature, the arc-shaped means communicates in a 2.4 GHz frequency band and the U-shaped means communicates in a 5 GHz frequency band.

In another feature, the inner ring means communicates in a 5 GHz frequency band and the outer ring means communicates in a 2.4 GHz frequency band.

In another feature, the first antenna means is printed on the PCB. The second and third antenna means are mounted on the PCB.

In another feature, the conducting means of the first antenna means communicates with a radio frequency (RF) transceiver. The second and third antenna means communicate with respective radio frequency (RF) transceivers.

In another feature, the PCB comprises first and second layers of electrically conducting means for communicating with the first, second, and third antenna means, and wherein the first layer is adjacent to a first surface of the PCB and the second layer is adjacent to a second surface of the PCB, and wherein the first surface is opposite to the second surface.

In another feature, the first layer and the first antenna means are printed on the first surface, and wherein the first layer is not joined to the first antenna means.

In another feature, the second and third antenna means are mounted on the first layer, and wherein the inner ring means of the second and third antenna means communicate with the first layer.

In another feature, the antenna system further comprises through-hole means for communicating between the first and second layers.

In another feature, the electrically conducting means includes copper.

In another feature, a wireless network device comprises the antenna system.

In another feature, a device comprises the antenna system wherein the device is compliant with Worldwide Interoperability for Microwave Access (WiMAX) standard.

In another feature, a wireless network device comprises the antenna system wherein the wireless network device operates in a wireless fidelity local area network and complies with at least one of IEEE 802.11a, 802.11b, 802.11g, 802.11n, and 802.16 standards.

In another feature, a cellular phone comprises the antenna system.

In still other features, an antenna system comprises first, second, and third antennas that are arranged on a printed circuit board (PCB) and that include an inner ring and an outer ring that is concentric to the inner ring.

In another feature, centers of the inner and outer rings of the first, second, and third antennas constitute vertices of a triangle. The triangle is one of an isosceles triangle and an equilateral triangle.

In another feature, the inner ring has a greater ring width than the outer ring, and wherein the ring width is a radial distance between an inner circumference and an outer circumference of each of the inner ring and the outer ring. The inner ring communicates with the outer ring.

In another feature, the first, second, and third antennas communicate in a dual frequency band in a 3×3 multiple input multiple output (MIMO) configuration.

In another feature, the first, second, and third antennas communicate in 2.4 GHz and 5 GHz frequency bands in a 3×3 multiple input multiple output (MIMO) configuration.

In another feature, the inner ring communicates in a 5 GHz frequency band and the outer ring communicates in a 2.4 GHz frequency band.

In another feature, the first, second, and third antennas are mounted on the PCB.

In another feature, the first, second, and third antennas communicate with a respective radio frequency (RF) transceiver.

In another feature, the PCB comprises a first electrically conducting layer that is adjacent to a first surface of the PCB and a second electrically conducting layer that is adjacent to a second surface of the PCB, and wherein the first surface is opposite to the second surface.

In another feature, the first, second, and third antennas are mounted on the first electrically conducting layer, and wherein the inner rings of the first, second, and third antennas communicate with the first electrically conducting layer.

In another feature, the first electrically conducting layer communicates with the second electrically conducting layer via through-holes.

In another feature, the first and second electrically conducting layers include copper.

In another feature, a wireless network device comprises the antenna system.

In another feature, a device comprises the antenna system wherein the device is compliant with Worldwide Interoperability for Microwave Access (WiMAX) standard.

In another feature, a wireless network device comprises the antenna system wherein the wireless network device operates in a wireless fidelity local area network and complies with at least one of IEEE 802.11a, 802.11b, 802.11g, 802.11n, and 802.16 standards.

In another feature, a cellular phone comprises the antenna system.

In still other features, a method comprises arranging an inner ring of each of first, second, and third antennas on a printed circuit board (PCB), and arranging an outer ring of each of the first, second, and third antennas concentrically with the inner ring of the first, second, and third antennas on the PCB, respectively.

In another feature, centers of the inner and outer rings of the first, second, and third antennas constitute vertices of a triangle.

In another feature, the method further comprises arranging the centers on vertices of one of an isosceles triangle and an equilateral triangle.

In another feature, the method further comprises communicating between the inner and outer rings, wherein the inner ring has a greater ring width than the outer ring, and wherein the ring width is a radial distance between an inner circumference and an outer circumference of each of the inner ring and the outer ring.

In another feature, the method further comprises configuring the first, second, and third antennas in a 3×3 multiple input multiple output (MIMO) configuration and communicating in a dual frequency band.

In another feature, the method further comprises configuring the first, second, and third antennas in a 3×3 multiple input multiple output (MIMO) configuration and communicating in 2.4 GHz and 5 GHz frequency bands.

In another feature, the method further comprises communicating in a 2.4 GHz frequency band with the outer ring and communicating in a 5 GHz frequency band with the inner ring.

In another feature, the method further comprises mounting the first, second, and third antennas on the PCB.

In another feature, the method further comprises communicating between the first, second, and third antennas and respective radio frequency (RF) transceivers.

In another feature, the method further comprises arranging a first electrically conducting layer adjacent to a first surface of the PCB, arranging a second surface of the PCB opposite to the first surface, and arranging a second electrically conducting layer adjacent to said second surface of the PCB.

In another feature, the method further comprises mounting the first, second, and third antennas on the first electrically conducting layer, and communicating between the first electrically conducting layer and the inner rings of the first, second, and third antennas.

In another feature, the method further comprises communicating between the first and second electrically conducting layers.

In another feature, the method further comprises providing copper in the first and second electrically conducting layers.

In still other features, an antenna system comprises first, second, and third antenna means for communicating radio frequency (RF) signals, wherein each of the first, second, and third antenna means is arranged on a printed circuit board (PCB) and includes inner ring means for communicating the RF signals and outer ring means for communicating the RF signals, wherein the inner and outer ring means are concentric.

In another feature, centers of the inner and outer ring means of the first, second, and third antenna means constitute vertices of a triangle. The triangle is one of an isosceles triangle and an equilateral triangle.

In another feature, the inner ring means has a greater ring width than the outer ring means, and wherein the ring width is a radial distance between an inner circumference and an outer circumference of each of the inner and outer ring means. The inner ring means communicates with the outer ring means.

In another feature, the first, second, and third antenna means communicate in a dual frequency band in a 3×3 multiple input multiple output (MIMO) configuration.

In another feature, the first, second, and third antenna means communicate in 2.4 GHz and 5 GHz frequency bands in a 3×3 multiple input multiple output (MIMO) configuration.

In another feature, the inner ring means communicates in a 5 GHz frequency band and the outer ring means communicates in a 2.4 GHz frequency band.

In another feature, the first, second, and third antenna means are mounted on the PCB.

In another feature, the first, second, and third antenna means communicate with a respective radio frequency (RF) transceiver.

In another feature, the PCB comprises first and second layers of electrically conducting means for communicating with the first, second, and third antenna means, and wherein the first layer is adjacent to a first surface of the PCB and the second layer is adjacent to a second surface of the PCB, and wherein the first surface is opposite to the second surface.

In another feature, the first, second, and third antenna means are mounted on the first layer, and wherein the inner ring means of each of the first, second, and third antenna means communicates with the first layer.

In another feature, the antenna system further comprises through-hole means for communicating between the first and second layers.

In another feature, the electrically conducting means includes copper.

In another feature, a wireless network device comprises the antenna system.

In another feature, a device comprises the antenna system wherein the device is compliant with Worldwide Interoperability for Microwave Access (WiMAX) standard.

In another feature, a wireless network device comprises the antenna system wherein the wireless network device operates in a wireless fidelity local area network and complies with at least one of IEEE 802.11a, 802.11b, 802.11g, 802.11n, and 802.16 standards.

In another feature, a cellular phone comprises the antenna system.

In still other features, an antenna system comprises first and second antennas that are arranged on a printed circuit board (PCB) and that include an arc-shaped element having a concave side and a convex side and a conducting element that extends substantially radially from a center of the concave side. The first and second antennas include a U-shaped element having a base portion with a center that communicates with the conducting element and two side portions that extend from ends of the base portion towards the concave side. The antenna system further comprises third and fourth antennas that are arranged on the PCB and that include an inner ring and an outer ring that is concentric to the inner ring.

In another feature, the two side portions and the conducting element are substantially parallel to each other and substantially perpendicular to the base portion.

In another feature, the inner ring has a greater ring width than the outer ring, and wherein the ring width is a radial distance between an inner circumference and an outer circumference of each of the inner ring and the outer ring. The inner ring communicates with the outer ring.

In another feature, the concave sides of the arc-shaped elements of the first and second antennas face the third and fourth antennas. A first line joining the centers of the concave sides is substantially parallel to a second line joining centers of the inner and outer rings of the third and fourth antennas. The conducting elements of the first and second antennas are substantially perpendicular to the first and second lines.

In another feature, the centers of the concave sides of the first and second antennas and centers of the inner and outer rings of the third and fourth antennas constitute vertices of a rectangle.

In another feature, the convex side of the arc-shaped element radiates electromagnetic radiation and the U-shaped element directs the electromagnetic radiation.

In another feature, the first, second, third, and fourth antennas communicate in a dual frequency band in a 4×4 multiple input multiple output (MIMO) configuration.

In another feature, the first, second, third, and fourth antennas communicate in 2.4 GHz and 5 GHz frequency bands in a 4×4 multiple input multiple output (MIMO) configuration.

In another feature, the arc-shaped element communicates in a 2.4 GHz frequency band and the U-shaped element communicates in a 5 GHz frequency band.

In another feature, the inner ring communicates in a 5 GHz frequency band and the outer ring communicates in a 2.4 GHz frequency band.

In another feature, the first and second antennas are printed on the PCB. The third and fourth antennas are mounted on the PCB.

In another feature, the conducting elements of the first and second antennas communicate with respective radio frequency (RF) transceivers. The third and fourth antennas communicate with respective radio frequency (RF) transceivers.

In another feature, the PCB comprises a first electrically conducting layer that is adjacent to a first surface of the PCB and a second electrically conducting layer that is adjacent to a second surface of the PCB, and wherein the first surface is opposite to the second surface.

In another feature, the first electrically conducting layer and the first and second antennas are printed on the first surface, and wherein the first electrically conducting layer is not joined to the first and second antennas.

In another feature, the third and fourth antennas are mounted on the first electrically conducting layer, and wherein the inner rings of the third and fourth antennas communicate with the first electrically conducting layer.

In another feature, the first electrically conducting layer communicates with the second electrically conducting layer via through-holes.

In another feature, the first and second electrically conducting layers include copper.

In another feature, a wireless network device comprises the antenna system.

In another feature, a device comprises the antenna system wherein the device is compliant with Worldwide Interoperability for Microwave Access (WiMAX) standard.

In another feature, a wireless network device comprises the antenna system wherein the wireless network device operates in a wireless fidelity local area network and complies with at least one of IEEE 802.11a, 802.11b, 802.11g, 802.11n, and 802.16 standards.

In another feature, a cellular phone comprises the antenna system.

In still other features, a method comprises arranging an arc-shaped element of each of first and second antennas on a printed circuit board (PCB), wherein the arc-shaped element has a concave side and a convex side, and extending a conducting element of each of the first and second antennas substantially radially from a center of the concave side of the arc-shaped element of each of the first and second antennas on the PCB, respectively. The method further comprises arranging a base portion of a U-shaped element of each of the first and second antennas on the PCB, communicating between a center of the base portion and the conducting element, and extending two side portions of the U-shaped element from ends of the base portion towards the concave side on the PCB. The method further comprises arranging an inner ring of each one third and fourth antennas concentrically with an outer ring of each of the third and fourth antennas on the PCB, respectively.

In another feature, the method further comprises arranging the two side portions and the conducting element substantially parallel to each other and substantially perpendicular to the base portion on the PCB.

In another feature, the method further comprises communicating between the inner and outer rings, wherein the inner ring has a greater ring width than the outer ring, and wherein the ring width is a radial distance between an inner circumference and an outer circumference of each of the inner ring and the outer ring.

In another feature, the method further comprises arranging the conducting element of the first antenna substantially perpendicular to a line joining centers of the inner and outer rings of the third and fourth antennas, arranging the conducting element of the second antenna substantially perpendicular to the line, and extending the conducting elements of the first and second antennas towards the line.

In another feature, the method further comprises arranging the centers of the concave sides of the first and second antennas and center of the inner and outer rings of the third and fourth antennas on vertices of a rectangle.

In another feature, the method further comprises radiating electromagnetic radiation from the convex side of the arc-shaped element and directing the electromagnetic radiation with the U-shaped element.

In another feature, the method further comprises configuring the first, second, third, and fourth antennas in a 4×4 multiple input multiple output (MIMO) configuration and communicating in a dual frequency band.

In another feature, the method further comprises communicating in a 2.4 GHz frequency band with the arc-shaped element and communicating in a 5 GHz frequency band with the U-shaped element.

In another feature, the method further comprises communicating in a 2.4 GHz frequency band with the outer ring and communicating in a 5 GHz frequency band with the inner ring.

In another feature, the method further comprises printing the first and second antennas on the PCB. The method further comprises mounting the third and fourth antennas on the PCB.

In another feature, the method further comprises communicating between each of the conducting elements of the first and second antennas and respective radio frequency (RF) transceivers.

In another feature, the method further comprises communicating between each of the third and fourth antennas and respective radio frequency (RF) transceivers.

In another feature, the method further comprises arranging a first electrically conducting layer adjacent to a first surface of the PCB and a second electrically conducting layer adjacent to a second surface of the PCB, wherein the first surface is opposite to the second surface.

In another feature, the method further comprises printing the first electrically conducting layer and the first and second antennas on the first surface, and not joining the first electrically conducting layer to the first and second antennas.

In another feature, the method further comprises mounting the third and fourth antennas on the first electrically conducting layer, and communicating between the first electrically conducting layer and the inner rings of the third and fourth antennas.

In another feature, the method further comprises communicating between the first and second electrically conducting layers.

In another feature, the method further comprises providing copper in the first and second electrically conducting layers.

In still other features, an antenna system comprises first and second antenna means for communicating radio frequency (RF) signals, wherein each of the first and second antenna means is arranged on a printed circuit board (PCB). Each of the first and second antenna means includes arc-shaped means for radiating the RF signals, wherein the arc-shaped means has a concave side and a convex side and conducting means for communicating with the arc-shaped means, wherein the conducting means extends substantially radially from a center of the concave side. Each of the first and second antenna means includes U-shaped means for communicating the RF signals, wherein the U-shaped means has a base portion with a center that communicates with the conducting means and two side portions that extend from ends of the base portion towards the concave side. The antenna system further comprises third and fourth antenna means for communicating the RF signals, wherein each of the third and fourth antenna means is arranged on the PCB and includes inner ring means for communicating the RF signals and outer ring means for communicating the RF signals, and wherein the inner and outer ring means are concentric.

In another feature, the two side portions and the conducting element are substantially parallel to each other and substantially perpendicular to the base portion.

In another feature, the inner ring means has a greater ring width than the outer ring means, and wherein the ring width is a radial distance between an inner circumference and an outer circumference of each of the inner ring means and outer ring means. The inner ring means communicates with the outer ring means.

In another feature, the concave sides of the arc-shaped means of the first and second antenna means face the third and fourth antenna means. A first line joining the centers of the concave sides is substantially parallel to a second line joining centers of the inner and outer ring means of the third and fourth antenna means. The conducting means of the first and second antenna means are substantially perpendicular to the first and second lines.

In another feature, the centers of the concave sides of the first and second antenna means and the centers of the inner and outer ring means of the third and fourth antenna means constitute vertices of a rectangle.

In another feature, the convex side of the arc-shaped means radiates electromagnetic radiation and the U-shaped means directs the electromagnetic radiation.

In another feature, the first, second, third, and fourth antenna means communicate in a dual frequency band in a 4×4 multiple input multiple output (MIMO) configuration.

In another feature, the first, second, third, and fourth antenna means communicate in 2.4 GHz and 5 GHz frequency bands in a 4×4 multiple input multiple output (MIMO) configuration.

In another feature, the arc-shaped means communicates in a 2.4 GHz frequency band and the U-shaped means communicates in a 5 GHz frequency band.

In another feature, the inner ring means communicates in a 5 GHz frequency band and the outer ring means communicates in a 2.4 GHz frequency band.

In another feature, the first and second antenna means are printed on the PCB. The third and fourth antenna means are mounted on the PCB.

In another feature, the conducting means of the first and second antenna means communicate with respective radio frequency (RF) transceivers. The third and fourth antenna means communicate with respective radio frequency (RF) transceivers.

In another feature, the PCB comprises first and second layers of electrically conducting means for communicating with the first, second, third, and fourth antenna means, and wherein the first layer is adjacent to a first surface of the PCB and the second layer is adjacent to a second surface of the PCB, and wherein the first surface is opposite to the second surface.

In another feature, the first layer and the first and second antenna means are printed on the first surface, and wherein the first layer is not joined to the first and second antenna means.

In another feature, the third and fourth antenna means are mounted on the first layer, and wherein the inner ring means of the third and fourth antenna means communicate with the first layer.

In another feature, the antenna system further comprises through-hole means for communicating between the first and second layers.

In another feature, the electrically conducting means includes copper.

In another feature, a wireless network device comprises the antenna system.

In another feature, a device comprises the antenna system wherein the device is compliant with Worldwide Interoperability for Microwave Access (WiMAX) standard.

In another feature, a wireless network device comprises the antenna system wherein the wireless network device operates in a wireless fidelity local area network and complies with at least one of IEEE 802.11a, 802.11b, 802.11g, 802.11n, and 802.16 standards.

In another feature, a cellular phone comprises the antenna system.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1A:
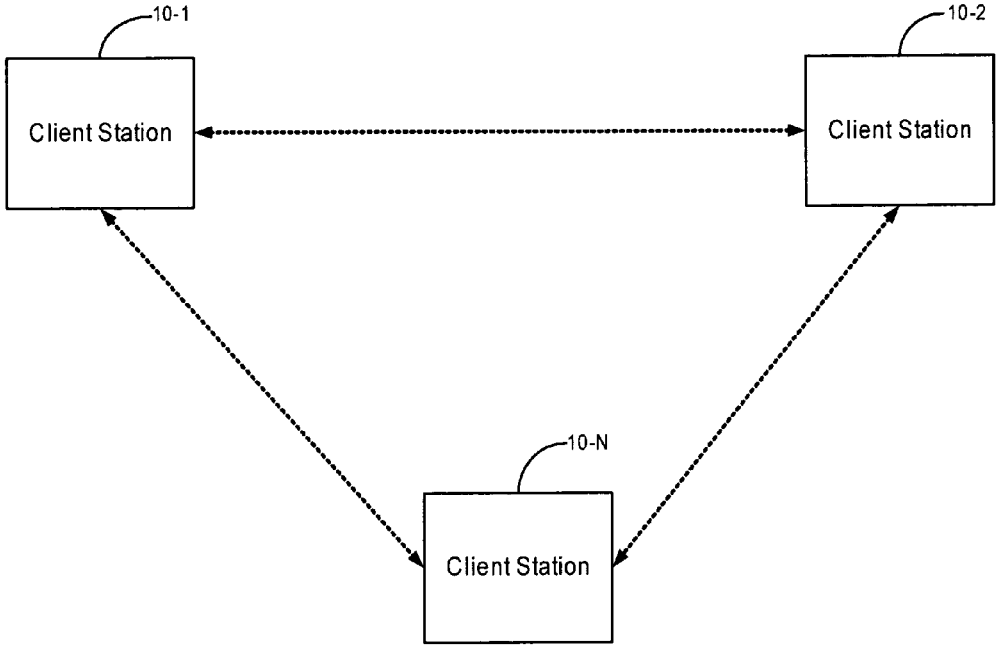
FIG. 1A Prior Art
FIG. 1A is a block diagram of an exemplary wireless network operating in an ad-hoc mode according to the prior art.
Figure 1B:
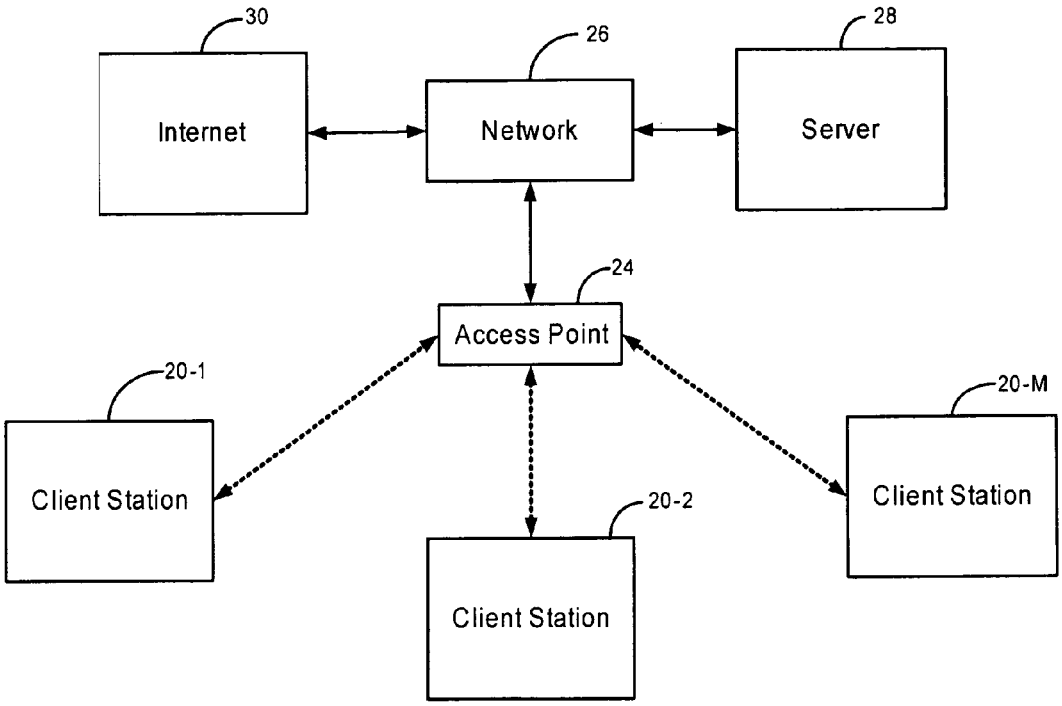
FIG. 1B Prior Art
FIG. 1B is a block diagram of an exemplary wireless network operating in an infrastructure mode according to the prior art.
Figure 1C:
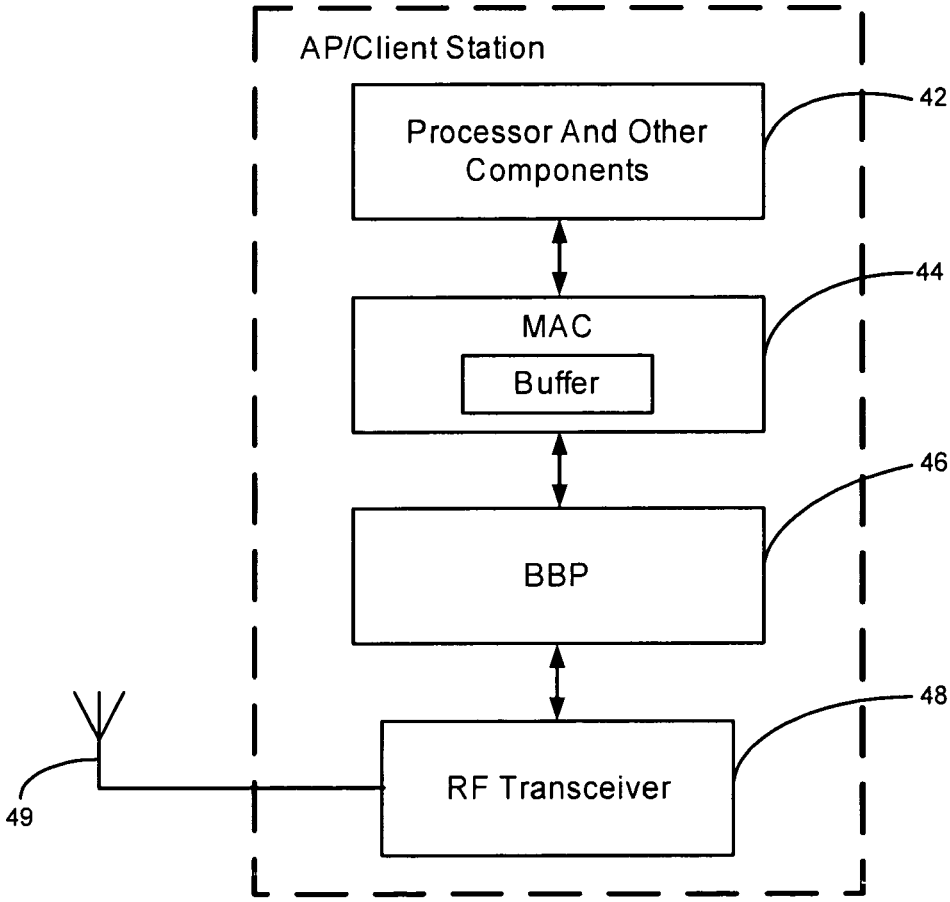
FIG. 1C Prior Art
FIG. 1C is an exemplary block diagram of a wireless network device according to the prior art.

The following description is merely exemplary in nature and is in no way intended to limit the present disclosure, its application, or uses. For purposes of clarity, the same reference numbers will be used in the drawings to identify similar elements. As used herein, the term module, circuit and/or device refers to an Application Specific Integrated Circuit (ASIC), an electronic circuit, a processor (shared, dedicated, or group) and memory that execute one or more software or firmware programs, a combinational logic circuit, and/or other suitable components that provide the described functionality. As used herein, the phrase at least one of A, B, and C should be construed to mean a logical (A or B or C), using a non-exclusive logical or. It should be understood that steps within a method may be executed in different order without altering the principles of the present disclosure.

Physical dimensions of a wireless device generally limit the number of antennas that can be installed in a multi-input multi-output (MIMO) configuration. Some antennas can be implemented by printing (i.e., etching) the antennas on printed circuit boards (PCBs). Antennas that cannot be implemented in the PCBs may be mounted on the PCBs. Whether antennas are implemented by printing on PCBs, mounting on PCBs, or by a combination of both, geometry and alignment of one antenna relative to another may determine isolation among antennas. High isolation among antennas may improve throughput rates of wireless devices.

Figure 2A:
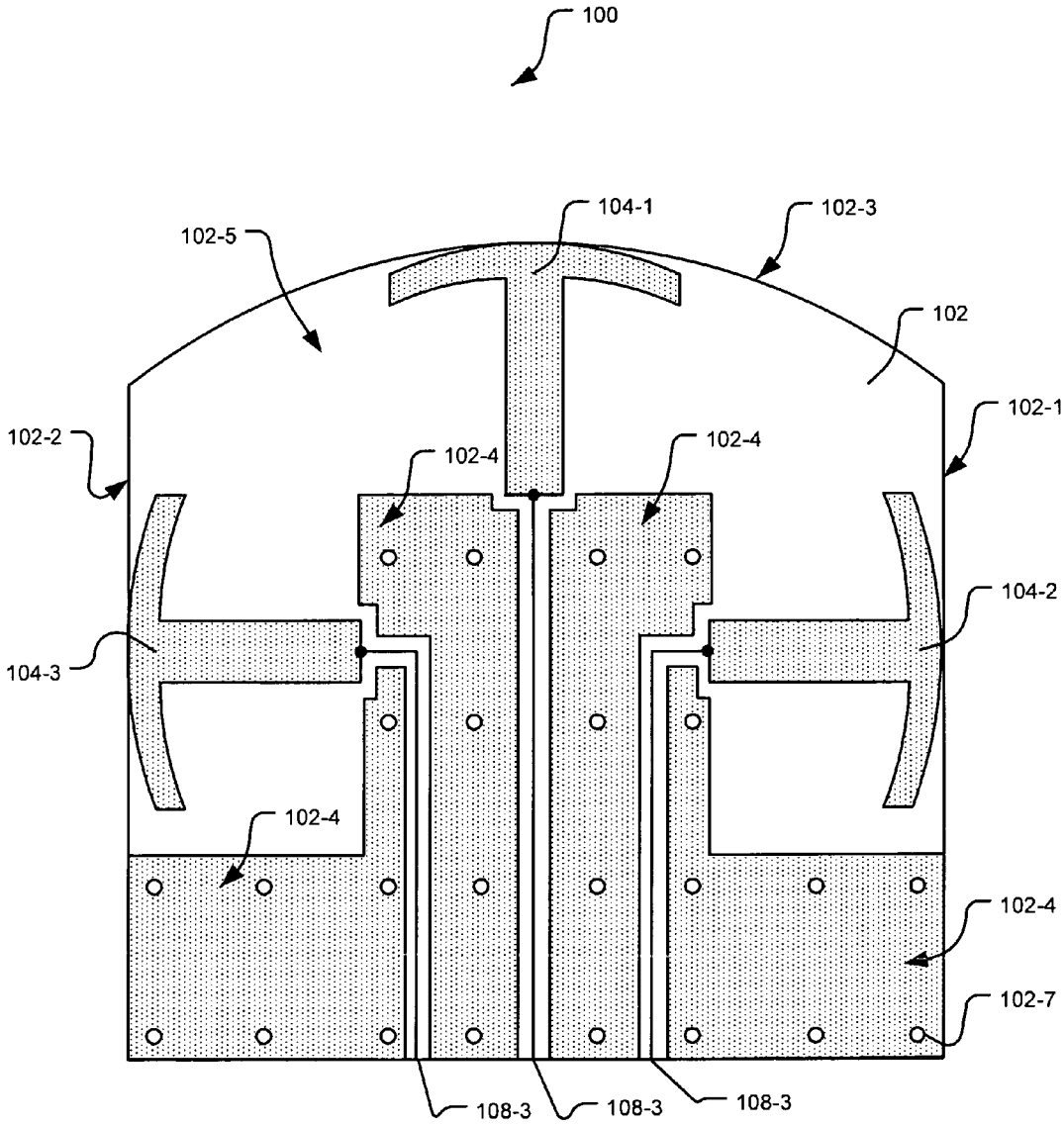
FIG. 2A shows a 3×3 single band antenna system printed on a printed circuit board (PCB) according to the present disclosure.

Referring now to FIGS. 2A-2E, a 3×3 single band antenna system 100 comprising three single band antennas is printed on a PCB 102. A first single band antenna 104-1, a second single band antenna 104-2, and a third single band antenna 104-3 (collectively single band antennas 104) are arranged in a 3×3 MIMO configuration on the PCB 102 as shown in FIG. 2A. The single band antennas 104 communicate in a 2.4 GHz frequency band.

Figure 2B:
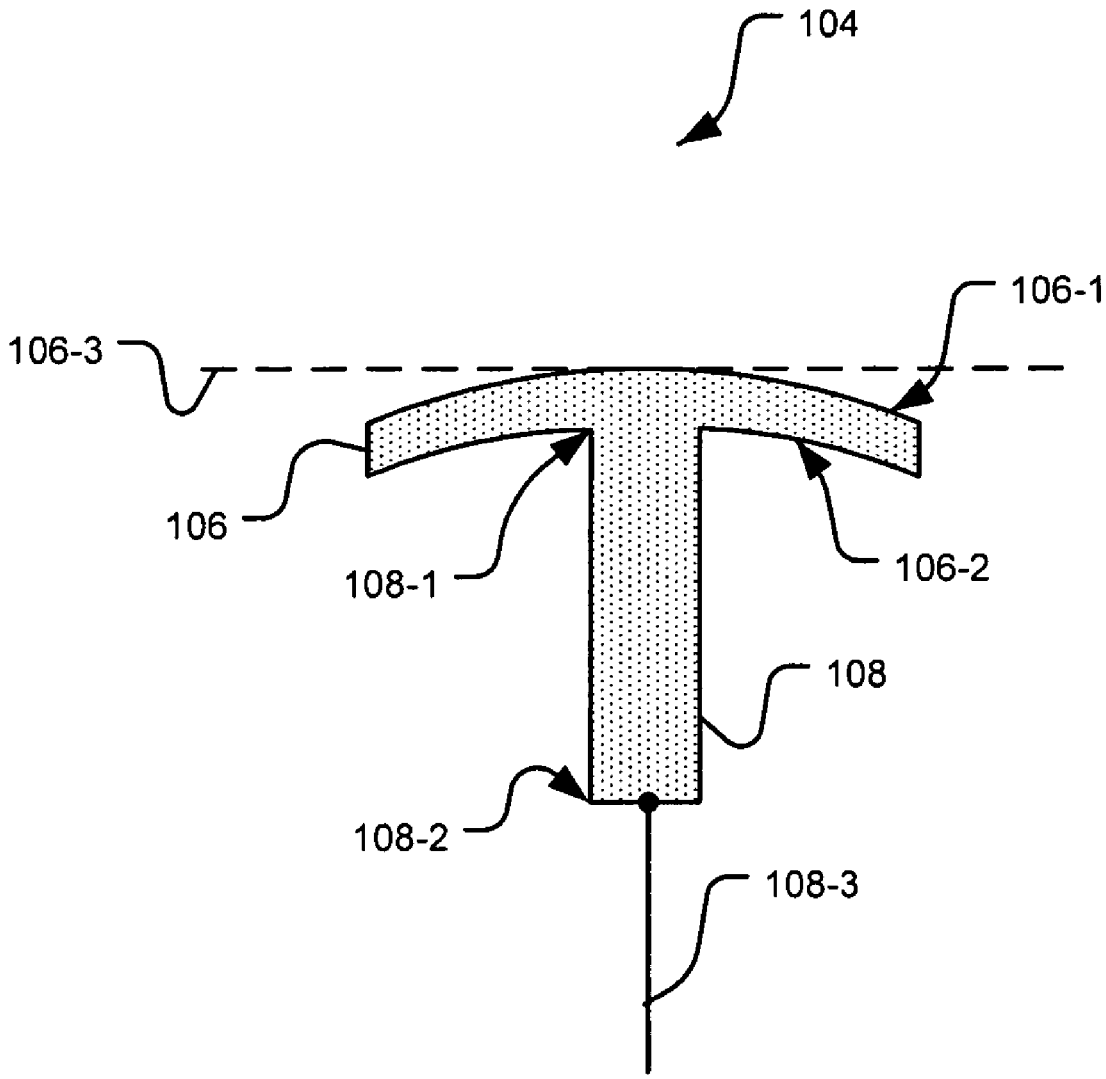
FIG. 2B shows a single band antenna used in the antenna system of FIG. 2A according to the present disclosure.

Each of the single band antennas 104 comprises two elements as shown in FIG. 2B. A first element 106 is arc-shaped. The first element 106 has a convex side 106-1 and a concave side 106-2. The first element 106 radiates electromagnetic radiation from the convex side 106-1. A conducting element 108 extends radially from a center of the concave side 106-2 and is perpendicular to a tangent 106-3 drawn at a center of the convex side 106-1.

The conducting element 108 has a first end 108-1 and a second end 108-2. The first end 108-1 is joined to the center of the concave side 106-2 of the first element 106. The conducting element 108 is perpendicular to the tangent 106-3. The second end 108-2 is connected to a radio frequency (RF) transceiver (not shown) by an electrical connection 108-3. The electrical connection 108-3 is etched on the PCB 102.

The single band antennas 104 are located on the PCB 102 as follows. The conducting elements 108 of the single band antennas 104-2 and 104-3 are collinear. The second end 108-2 of the conducting element 108 of the single band antenna 104-2 forms a first vertex of a triangle. The second end 108-2 of the conducting element 108 of the single band antenna 104-3 forms a second vertex of the triangle. A line joining the first vertex and the second vertex forms a base of the triangle. The triangle may be an isosceles or an equilateral triangle.

The convex sides 106-1 of the first elements 106 of the single band antennas 104-2 and 104-3 are opposite and face away from each other. Specifically, the convex side 106-1 of the first element 106 of the single band antenna 104-2 is adjacent to a first edge 102-1 of the PCB 102. The convex side 106-1 of the first element 106 of the single band antenna 104-3 is adjacent to a second edge 102-2 of the PCB 102. The first edge 102-1 is opposite and parallel to the second edge 102-2.

A tangent 106-3 drawn at the center of the convex side 106-1 of the first element 106 of the single band antenna 104-2 is parallel to a tangent 106-3 drawn at the center of the convex side 106-1 of the first element 106 of the single band antenna 104-3. The first vertex, the second vertex, the center of the concave side 106-2 of the single band antenna 104-2, and the center of the concave side 106-2 of the single band antenna 104-3 are collinear.

The conducting element 108 of the single band antenna 104-1 is perpendicular to the conducting elements 108 of the single band antennas 104-2 and 104-3. The second end 108-2 of the conducting element 108 of the single band antenna 104-1 forms a third vertex of the triangle. The first element 106 of the single band antenna 104-1 is adjacent to a third edge 102-3 of the PCB 102. A tangent 106-3 drawn at the center of the convex side 106-1 of the first element 106 of the single band antenna 104-1 is parallel to the base of the triangle and perpendicular to the tangents 106-3 drawn at centers of convex sides 106-1 of the first elements 106 of the single band antennas 104-2 and 104-3.

Figure 2C:
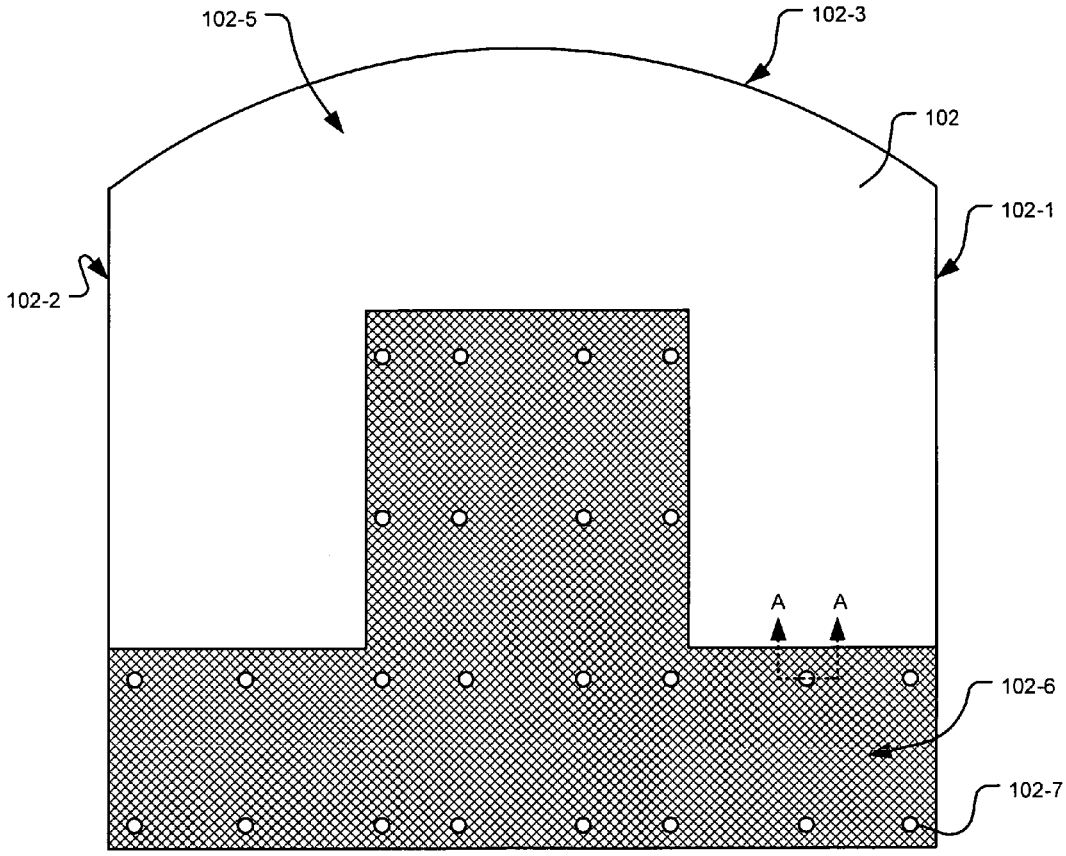
FIG. 2C shows an inner ground layer in the PCB of FIG. 2A.
Figure 2D:
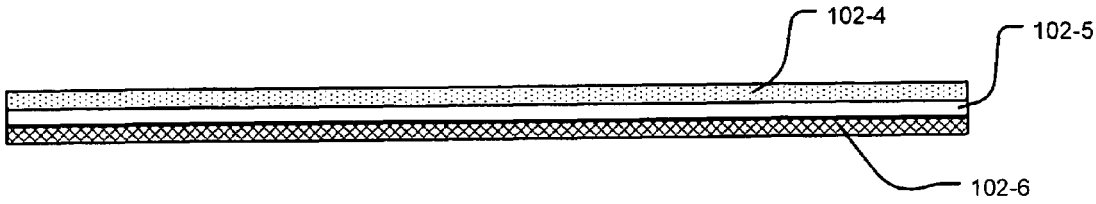
FIG. 2D is a cross-sectional view of the PCB of FIG. 2A showing different layers of the PCB.
Figure 2E:
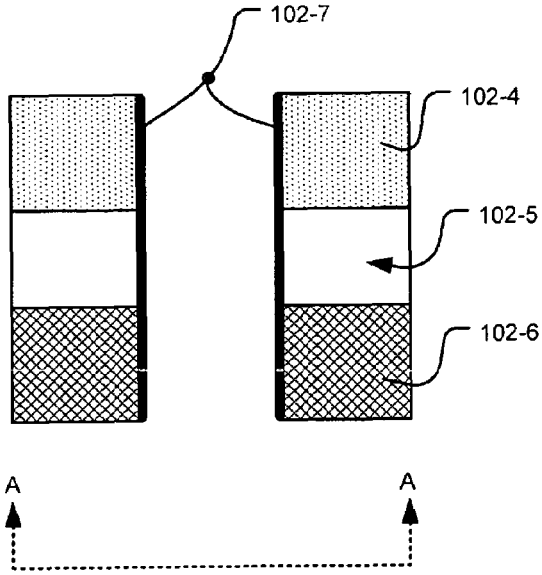
FIG. 2E is a cross-sectional view of a via-hole (i.e., a through-hole) in the PCB of FIG. 2A.

The single band antennas 104 are printed on a top surface 102-5 of the PCB 102 as shown in FIG. 2A. A layer of copper adjacent to the top surface 102-5 forms a top or an outer ground layer 102-4. Additionally, a layer of copper adjacent to a surface that is opposite to the top surface 102-5 forms a bottom or an inner ground layer 102-6 as shown in FIG. 2C. The top surface 102-5 separates and insulates the top ground layer 102-4 from the bottom ground layer 102-6 as shown in FIG. 2D. The top and bottom ground layers are connected by via-holes or through holes 102-7 as shown in FIG. 2E. Although copper is shown as an example, other electrically conducting materials may be used.

Figure 3A:
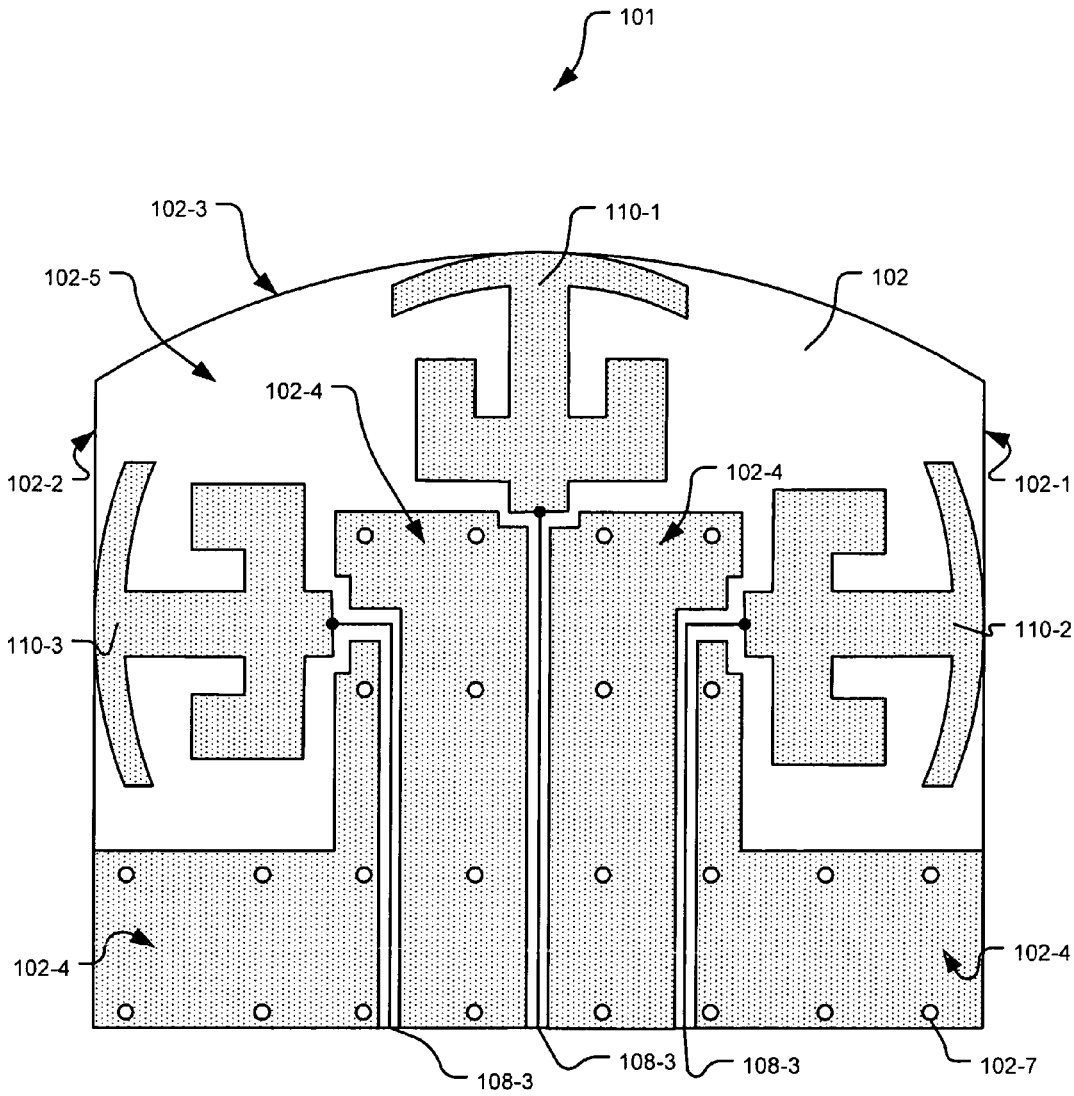
FIG. 3A shows a 3×3 dual band antenna system printed on a printed circuit board (PCB) according to the present disclosure.

Referring now to FIGS. 3A-3E, a 3×3 dual band antenna system 101 comprising three dual band antennas is printed on the PCB 102. A first dual band antenna 110-1, a second dual band antenna 110-2, and a third dual band antenna 110-3 (collectively dual band antennas 110) are arranged in a 3×3 MIMO configuration on the PCB 102 as shown in FIG. 3A. The dual band antennas 110 communicate in 2.4 GHz and 5 GHz frequency bands.

Figure 3B:
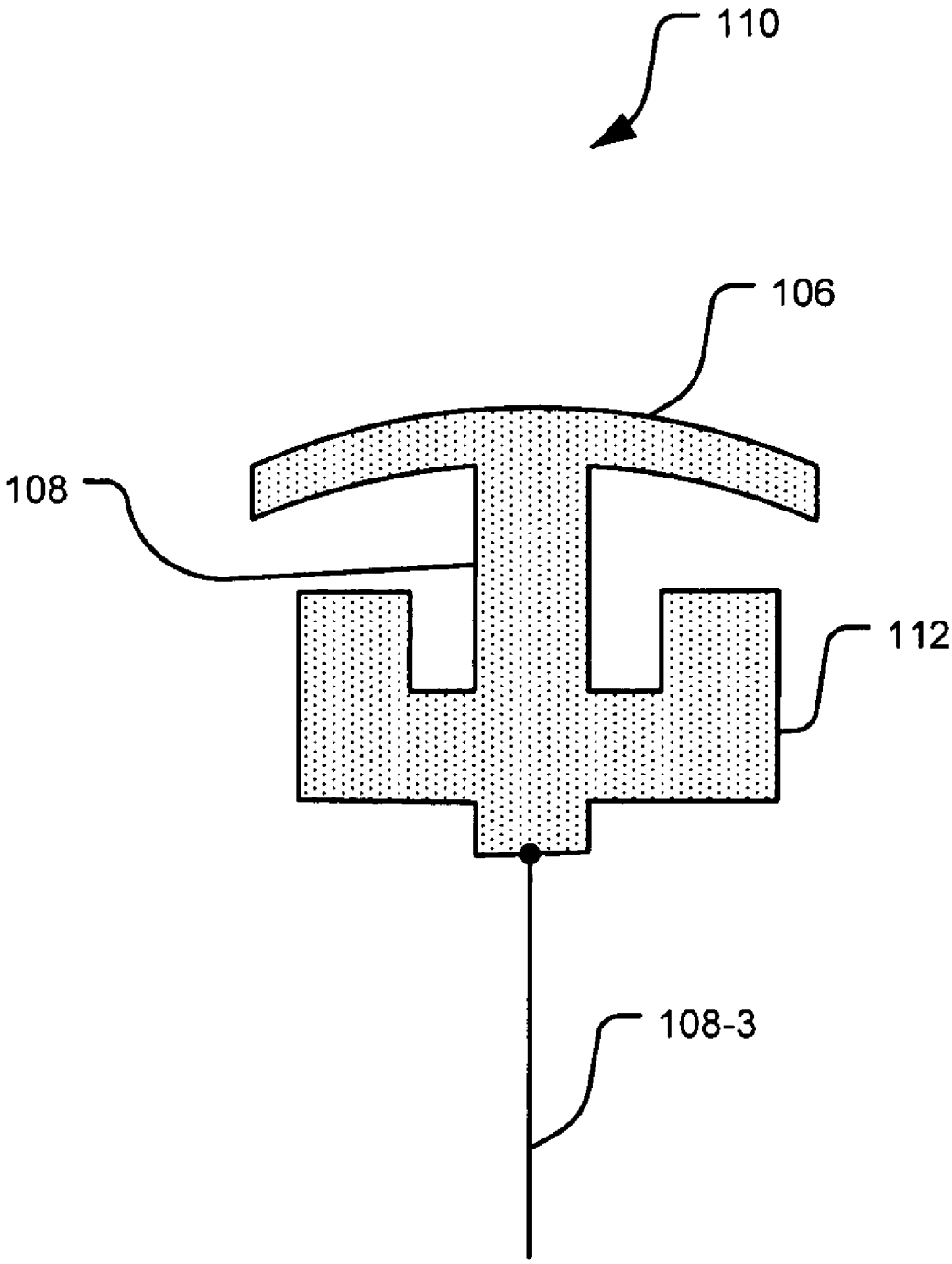
FIG. 3B shows a dual band antenna used in the antenna system of FIG. 3A according to the present disclosure.
Figure 3C:
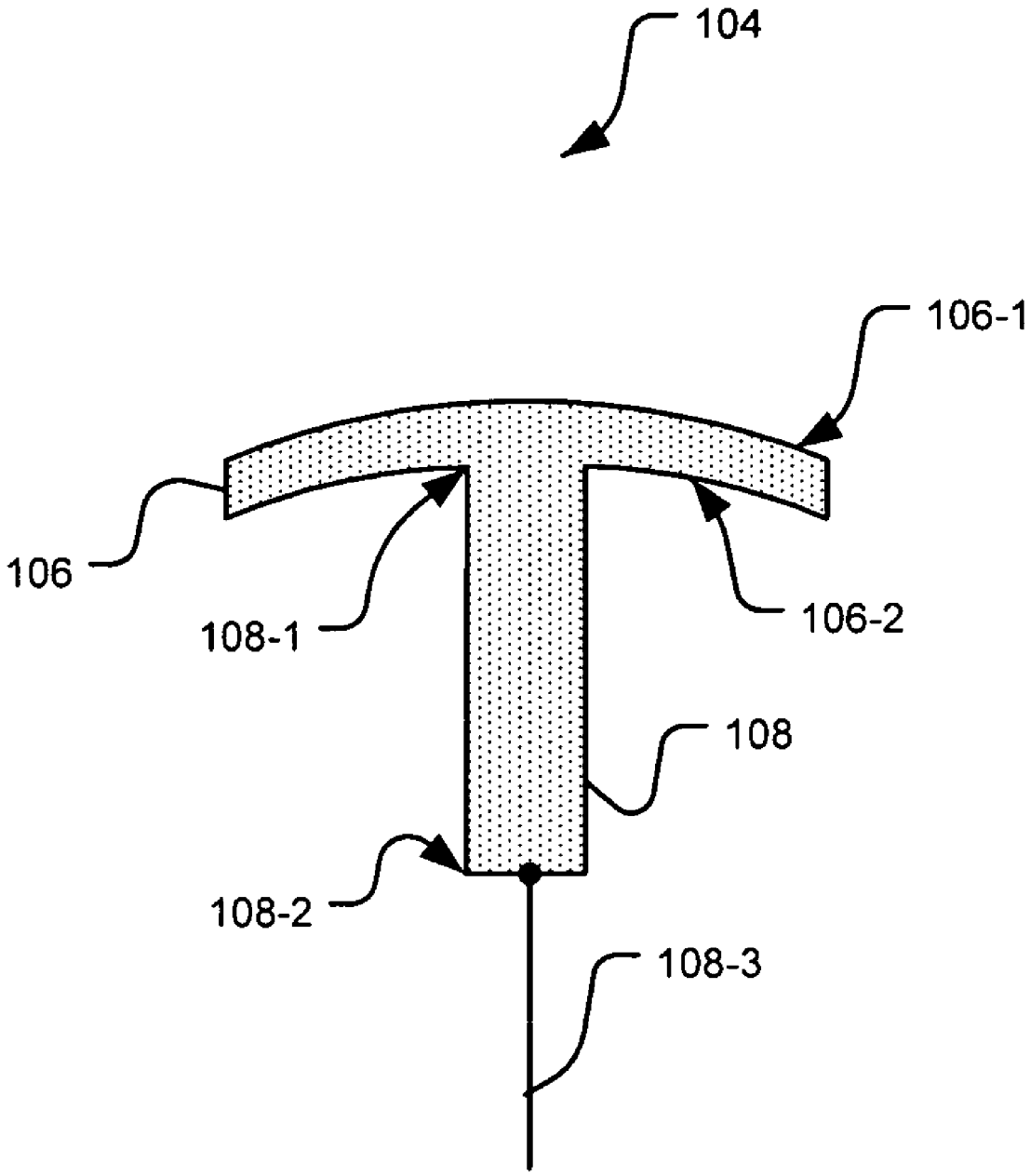
FIG. 3C shows a single band antenna used as an element of the dual band antenna of FIG. 3B according to the present disclosure.
Figure 3D:
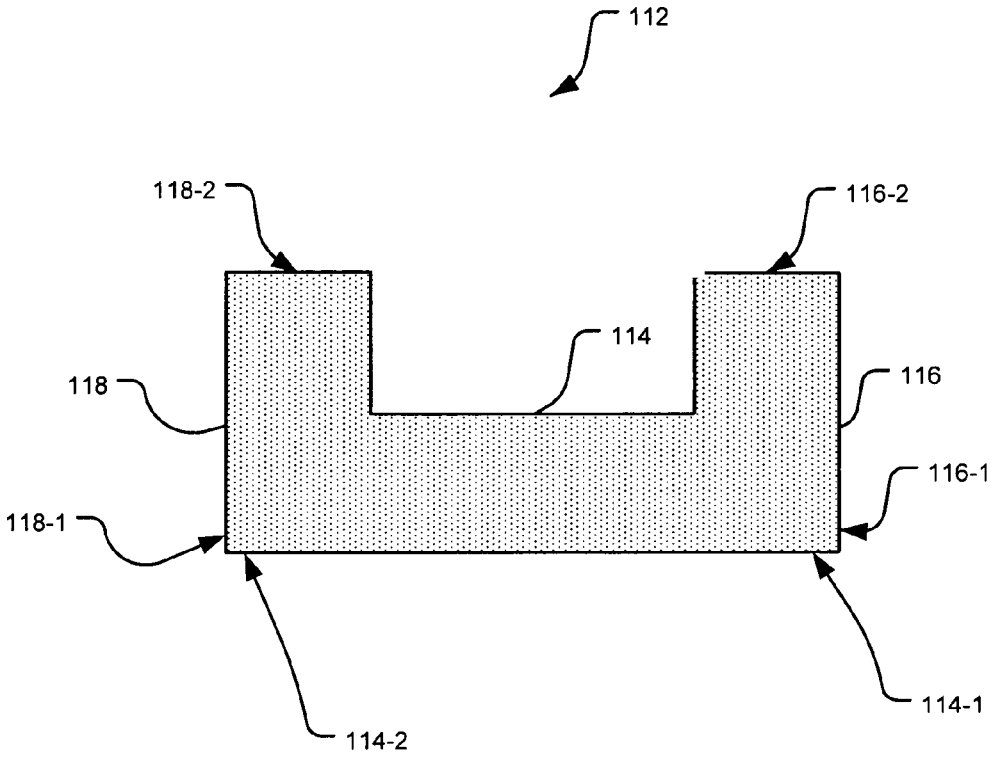
FIG. 3D shows an element of the dual band antenna of FIG. 3B according to the present disclosure.

Each of the dual band antennas 110 comprises one of the single band antennas 104 of the 3×3 single band antenna system 100 and a third element 112 as shown in FIGS. 3B-3D. Thus, each of the dual band antennas 110 comprises the first element 106, the conducting element 108, and the third element 112.

In each of the dual band antennas 110, the first element 106 communicates in the 2.4 GHz frequency band. The third element 112 communicates in the 5 GHz band. The first element 106 radiates electromagnetic radiation from the convex side 106-1. The third element 112 directs the electromagnetic radiation radiated by the convex side 106-1.

The conducting element 108 is connected to the first element 106 and to a RF transceiver (not shown) in the same manner as in the single band antennas 104 of the antenna system 100. The first elements 106 and the conducting elements 108 of the dual band antennas 110 are printed on the PCB 102 in the same manner as in the antenna system 100.

Additionally, the third elements 112 of the dual band antennas 110 are located and printed on the PCB 102 as follows. The third element 112 comprises three components as shown in FIG. 3D. Each of the three components has two ends. A first component 114 is perpendicular to the conducting element 108. A center of the first component 114 is joined to the conducting element 108 at a right angle near the second end 108-2. A second component 116 and a third component 118 are parallel to the conducting element 108. A length of the second component 116 is equal to a length of the third component 118 and is less than a length of the first component 114.

A first end 114-1 of the first component 114 is joined to a first end 116-1 of the second component 116 at a right angle. A second end 114-2 of the first component 114 is joined to a first end 118-1 of the third component 118 at a right angle. A second end 116-2 of the second component 116 and a second end 118-2 of the third component 118 point towards the concave side 106-2 of the first element 106. That is, a second end 116-2 of the second component 116 and a second end 118-2 of the third component 118 point away from the second end 108-2 of the conducting element 108. Thus, the third element 112 may be referred to as a U-shaped element comprising a base portion 114 and two side portions 116 and 118.

Figure 3E:
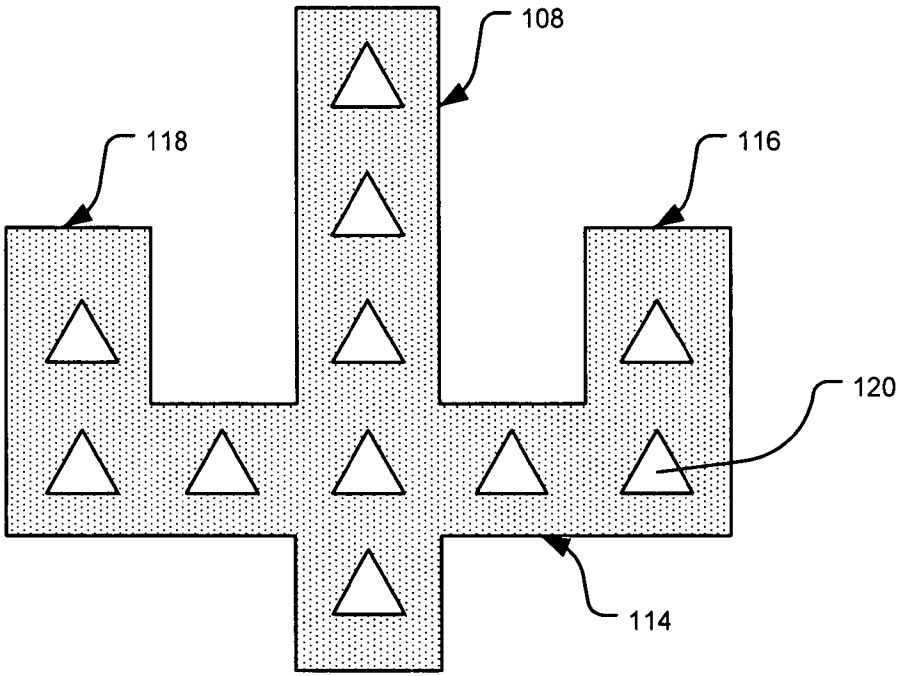
FIG. 3E shows exemplary triangular shapes etched on a dual band antenna of FIG. 3B when the dual band antenna is printed on a PCB according to the present disclosure.

The third element 112 and the conducting element 108 comprise areas 120 that may be etched on the PCB 102 as shown in FIG. 3E. The shape of the areas 120 can be that of a triangle as shown or any other shape such as a square, a rectangle, a circle, a hexagon, etc. The areas 120 may increase gain of the dual band antennas 110. The areas 120 may be arranged adjacent to one another along the lengths of the conducting elements 108 and the three components of the third elements 112 of the dual band antennas 110.

The dual band antennas 110 are printed on a top surface 102-5 of the PCB 102 as shown in FIG. 3A. A layer of copper adjacent to the top surface 102-5 forms a top or an outer ground layer 102-4. Additionally, a layer of copper adjacent to a surface that is opposite to the top surface 102-5 forms a bottom or an inner ground layer 102-6 as shown in FIG. 2C. The top surface 102-5 separates and insulates the top ground layer 102-4 from the bottom ground layer 102-6 as shown in FIG. 2D. The top and bottom ground layers are connected by via-holes or through holes 102-7 as shown in FIG. 2E. Although copper is shown as an example, other electrically conducting materials may be used.

Figure 4A:
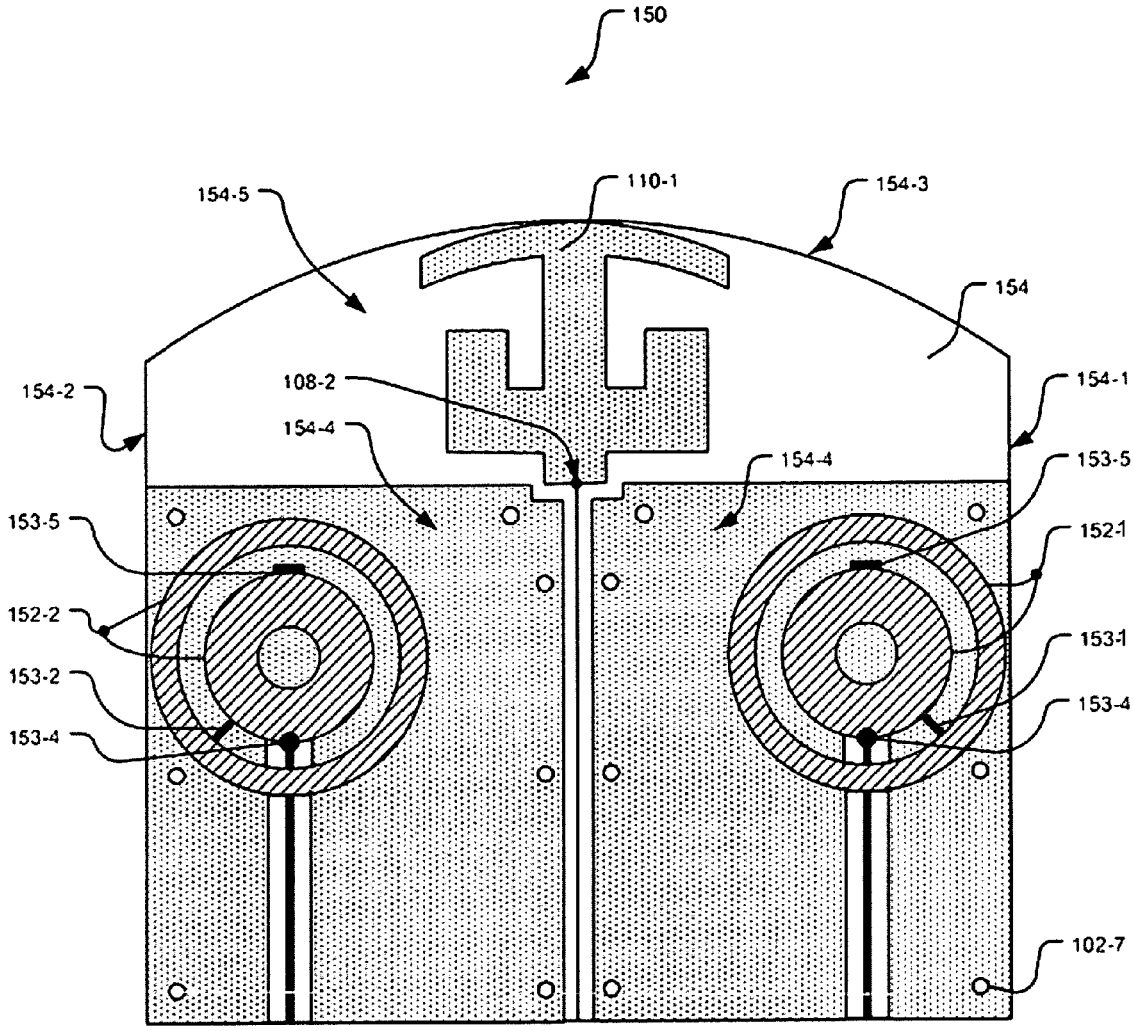
FIG. 4A shows an antenna system comprising a dual band antenna of FIG. 3B printed on a PCB and two ring antennas mounted on the PCB according to the present disclosure.

Referring now to FIGS. 4A-4K, a 3×3 dual band antenna system 150 comprising ring antennas includes a dual band antenna 110-1, a first ring antenna 152-1, and a second ring antenna 152-2. The first ring antenna 152-1 and the second ring antenna 152-2 (collectively ring antennas 152) are also dual band antennas. The dual band antenna 110-1 and the ring antennas 152 are arranged in a 3×3 MIMO configuration on a PCB 154 as shown in FIG. 4A. The dual band antenna 110-1 is printed on the PCB 154. The ring antennas 152 are not printed on the PCB 154. Instead, the ring antennas 152 are mounted on the PCB 154. Printing and mounting is shown by two different shading patterns.

The dual band antenna 110-1 communicates in 2.4 GHz and 5 GHz frequency bands. The elements and components of the dual band antenna 110-1 are identical to the elements and components of the dual band antenna 110-1 in the 3×3 dual band antenna system 101. The dual band antenna 110-1 is located adjacent to an edge 154-3 of the PCB 154 in the same manner as the dual band antenna 110-1 is located adjacent to the edge 102-3 of the PCB 102 in the 3×3 dual band antenna system 101. The dual band antenna 110-1 is connected to a RF transceiver (not shown) by an electrical connection 108-3. The electrical connection 108-3 is etched on the PCB 154.

The ring antennas 152 communicate in 2.4 GHz and 5 GHz frequency bands. The ring antennas 152 are connected to respective RF transceivers (not shown) by electrical connections 108-4. The electrical connections 108-4 are connected to the ring antennas 152 at locations identified by numbers 1534. The electrical connections 108-4 may or may not be etched on the PCB 154. The electrical connections 108-4 may comprise insulated conductors.

Figure 4B:
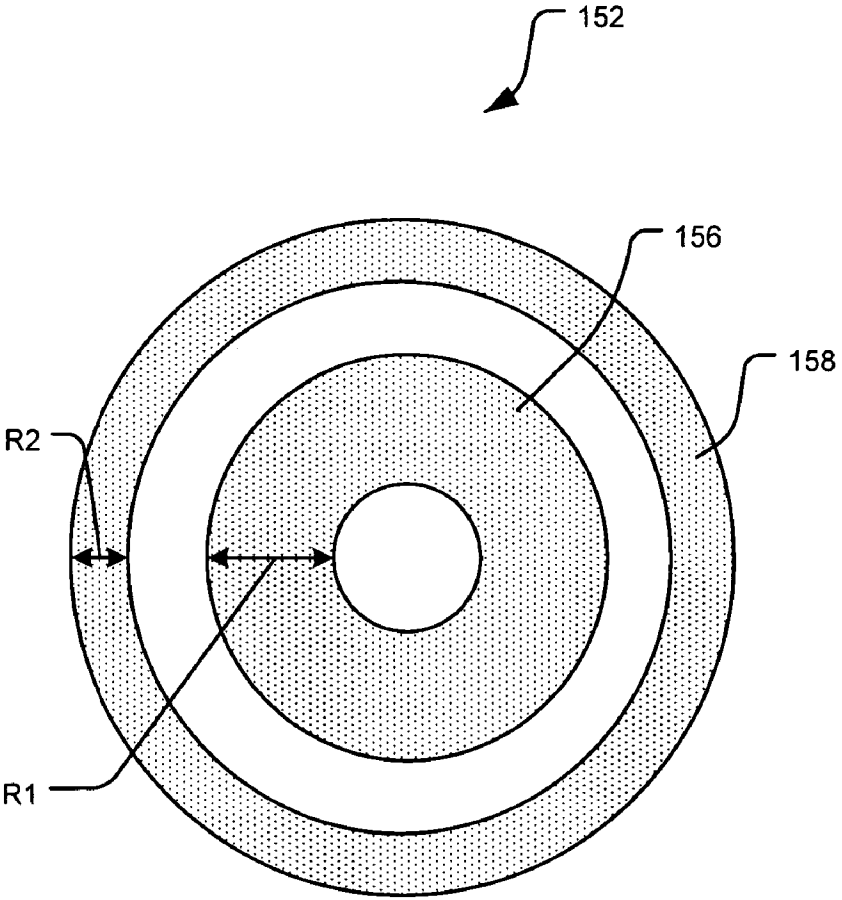
FIG. 4B shows geometry of a ring antenna used in the antenna system of FIG. 4A according to the present disclosure.
Figure 4C:
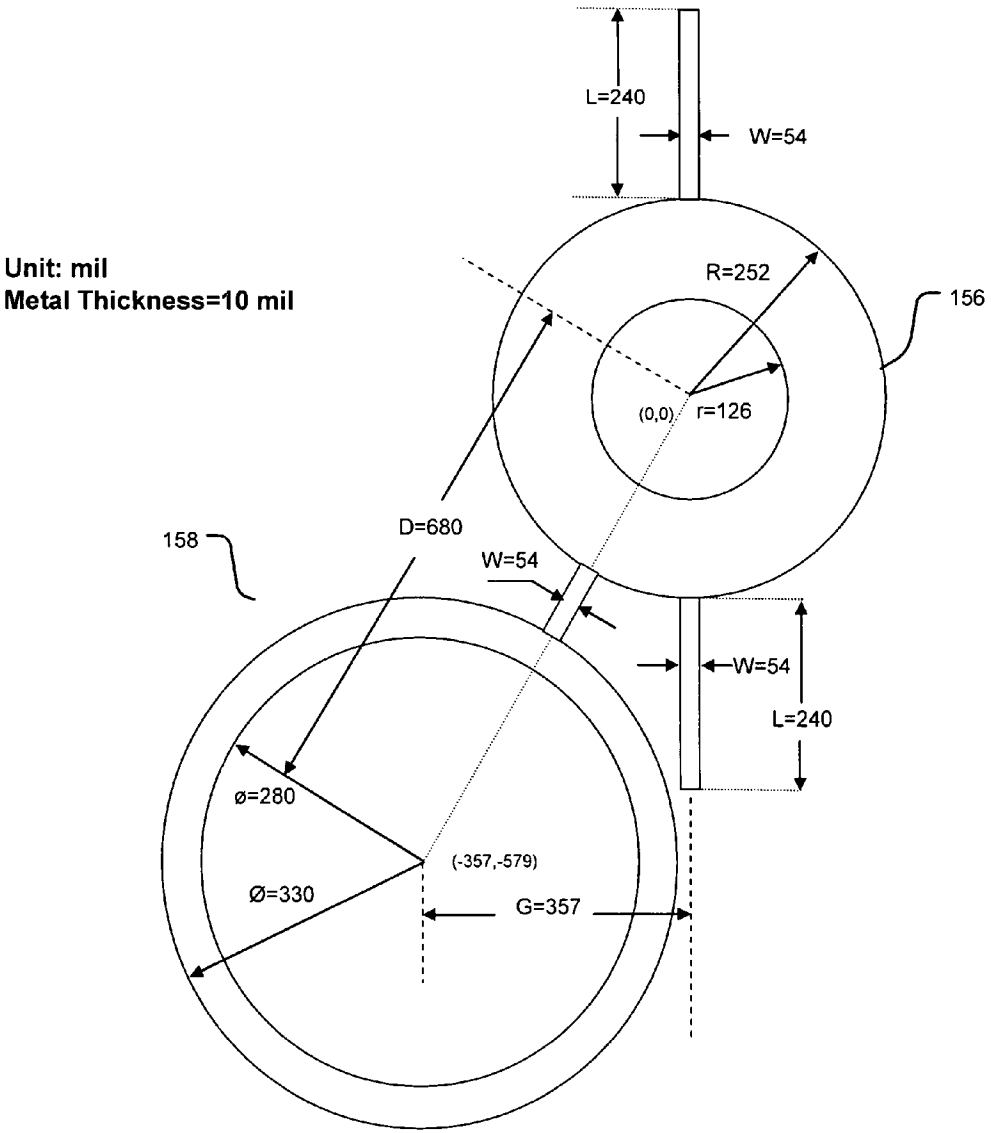
FIG. 4C is a mechanical drawing showing exemplary physical specifications of the two ring antennas used in the antenna system of FIG. 4A according to the present disclosure.
Figure 4D:
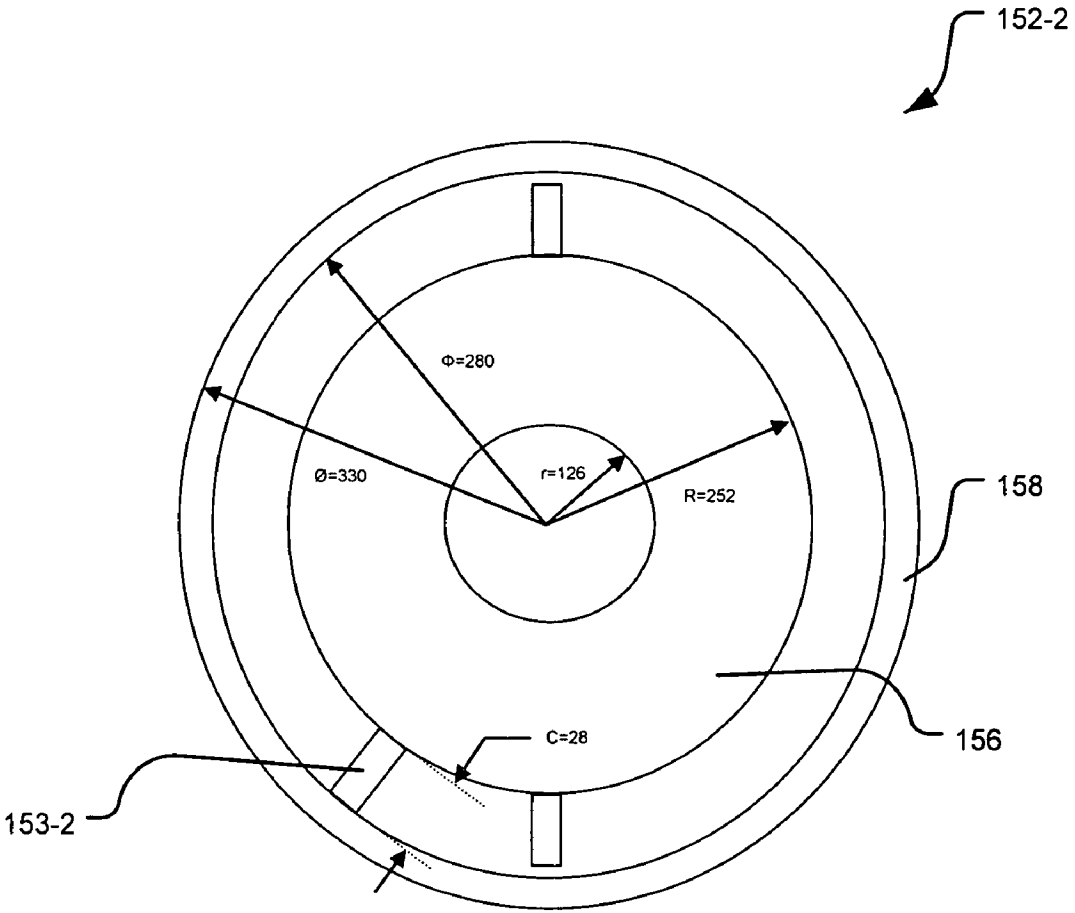
FIG. 4D is a mechanical drawing showing top view and exemplary physical specifications of a left ring antenna used in the antenna system of FIG. 4A according to the present disclosure.
Figure 4E:
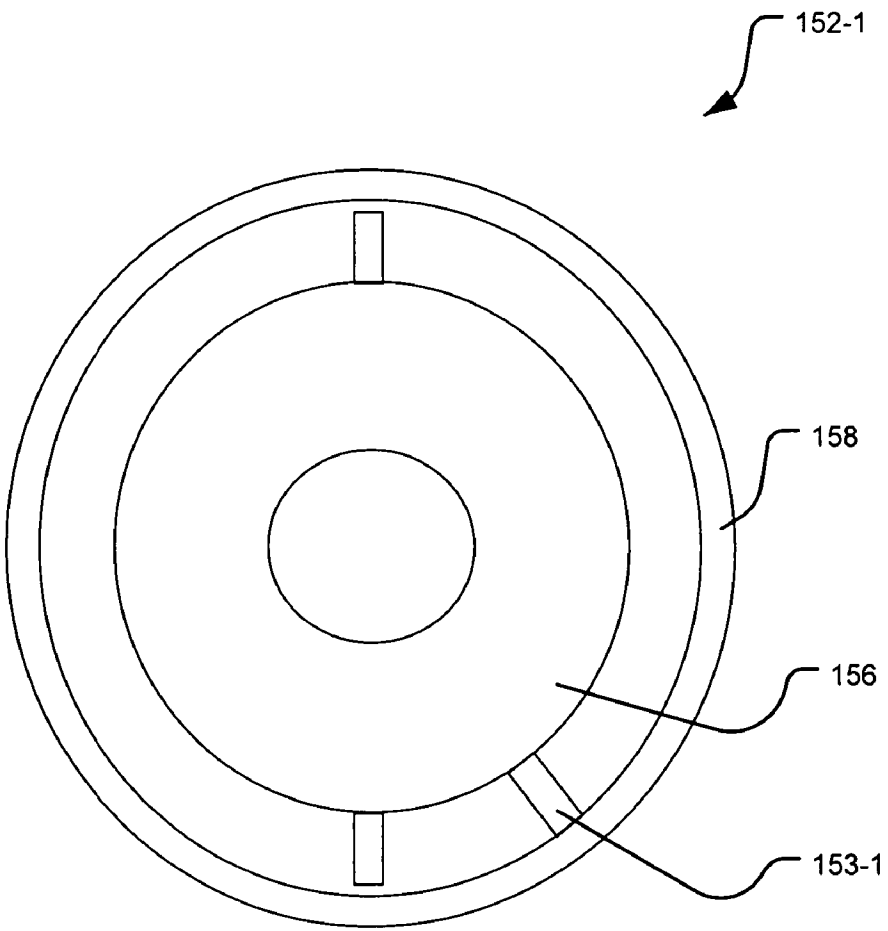
FIG. 4E is a mechanical drawing showing top view of a right ring antenna used in the antenna system of FIG. 4A according to the present disclosure.
Figure 4F:
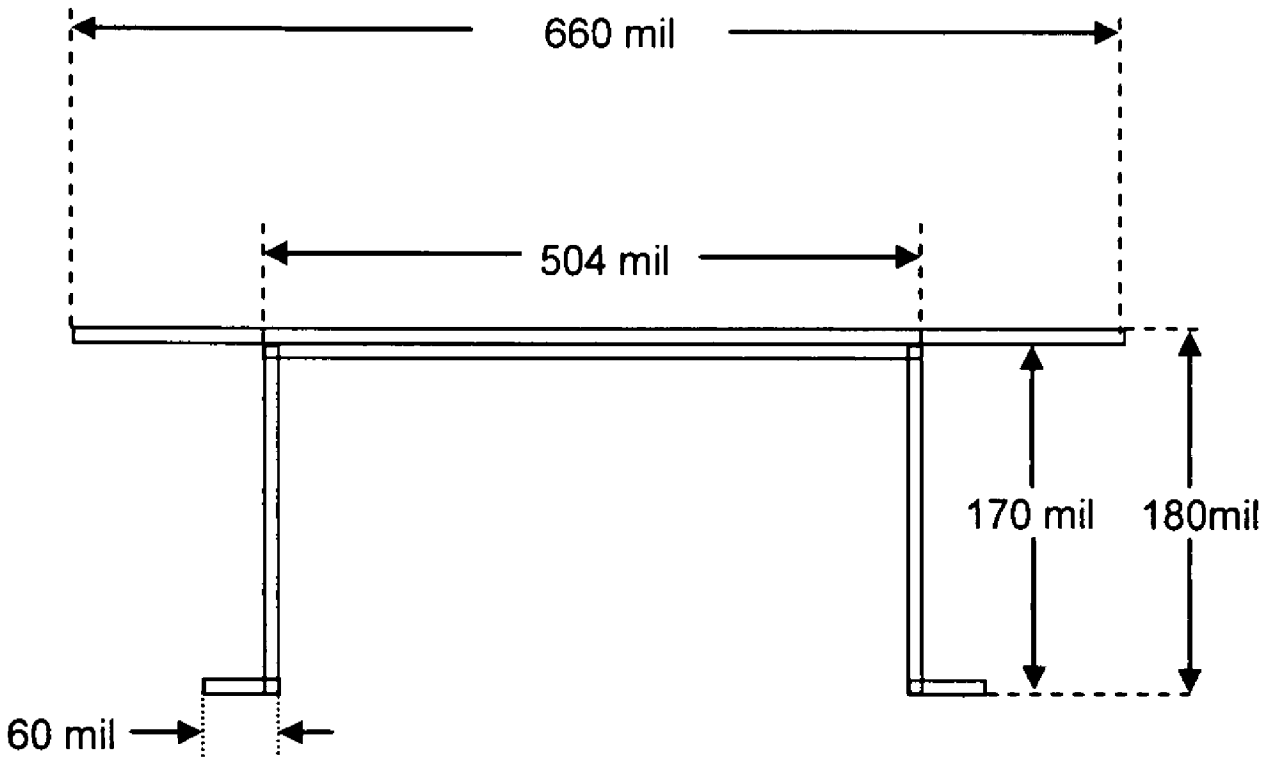
FIG. 4F is a mechanical drawing showing right side view and exemplary physical specifications of the ring antennas used in the antenna system of FIG. 4A according to the present disclosure.
Figure 4G:
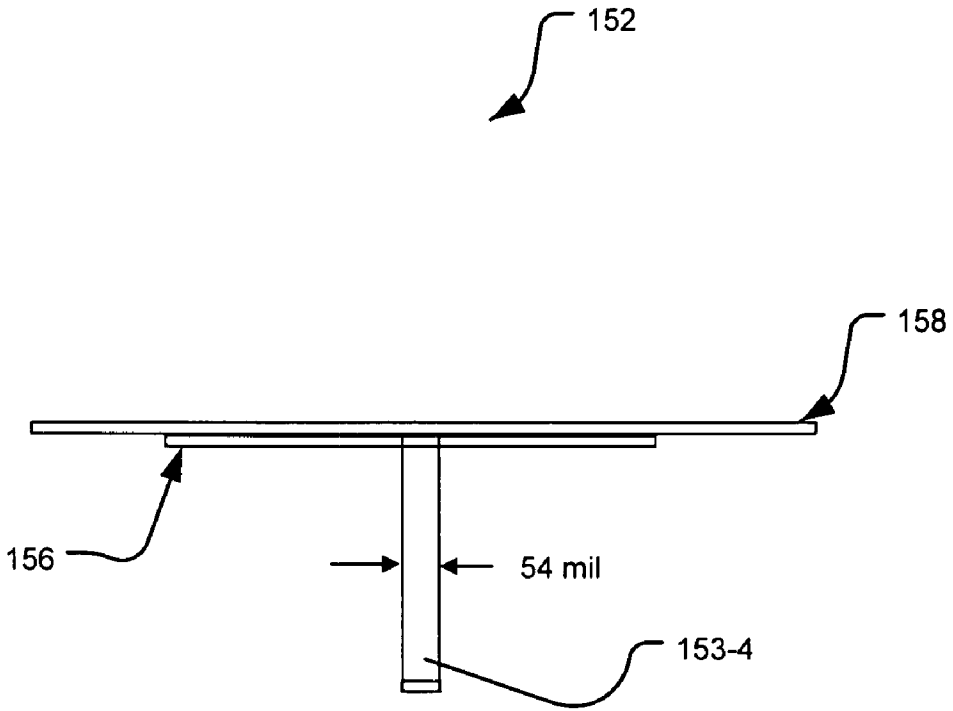
FIG. 4G is a mechanical drawing showing front side view and exemplary physical specifications of the ring antennas used in the antenna system of FIG. 4A according to the present disclosure.

Each of the ring antennas 152 comprises two concentric rings as shown in FIG. 4B. An inner ring 156 communicates in the 5 GHz frequency band. An outer ring 158 communicates in the 2.4 GHz frequency band. The inner ring 156 is wider than the outer ring 158. That is, a ring width R1 of the inner ring 156 is greater than the ring width R2 of the outer ring 158, where a ring width is a radial distance between an inner circumference and an outer circumference of a ring.

In the first ring antenna 152-1, the inner ring 156 is joined to the outer ring 158 at a location identified by the number 153-1. In the second ring antenna 152-2, the inner ring 156 is joined to the outer ring 158 at a location identified by the number 153-2. Detailed mechanical specifications and views of the ring antennas 152 are shown in FIGS. 4C-4H.

The ring antennas 152 are located on the PCB 154 as follows. A center of the first ring antenna 152-1 forms a first vertex of a triangle. A center of the second ring antenna 152-2 forms a second vertex of the triangle. A line joining the first vertex and the second vertex forms a base of the triangle. The second end 108-2 of the conducting element 108 of the dual band antenna 110-1 forms a third vertex of the triangle. The conducting element 108 is perpendicular to the base of the triangle. The triangle may be an isosceles or an equilateral triangle.

Figure 4H:
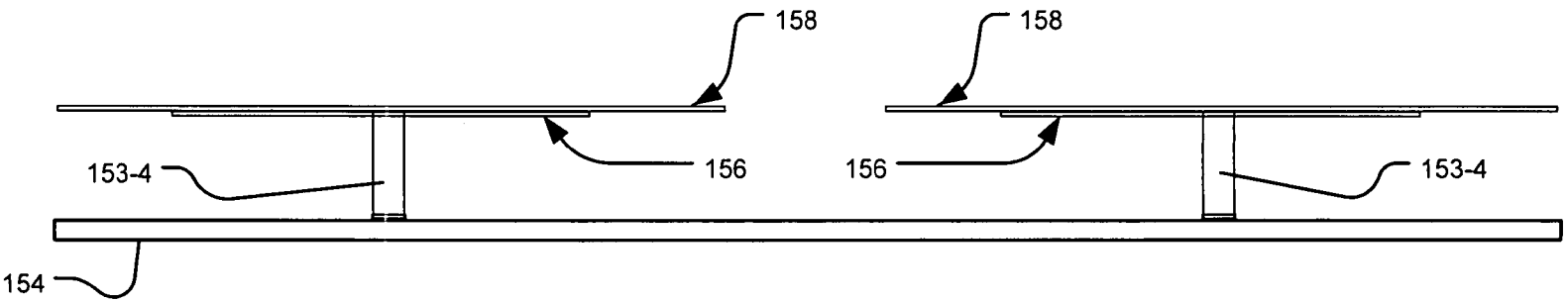
FIG. 4H is a mechanical drawing showing a front side view of the ring antennas mounted on a PCB in the antenna system of FIG. 4A according to the present disclosure.

The ring antennas 152 are located on opposite sides of the conducting element 108 of the dual band antenna 110-1. The outer ring 158 of the first ring antenna 152-1 is adjacent to a first edge 154-1 of the PCB 154. The outer ring 158 of the second ring antenna 152-2 is adjacent to a second edge 154-2 of the PCB 154. The first edge 154-1 is opposite and parallel to the second edge 154-2. FIG. 4H shows the ring antennas 152 as viewed along the edge 154-3 of the PCB 154.

Figure 4I:
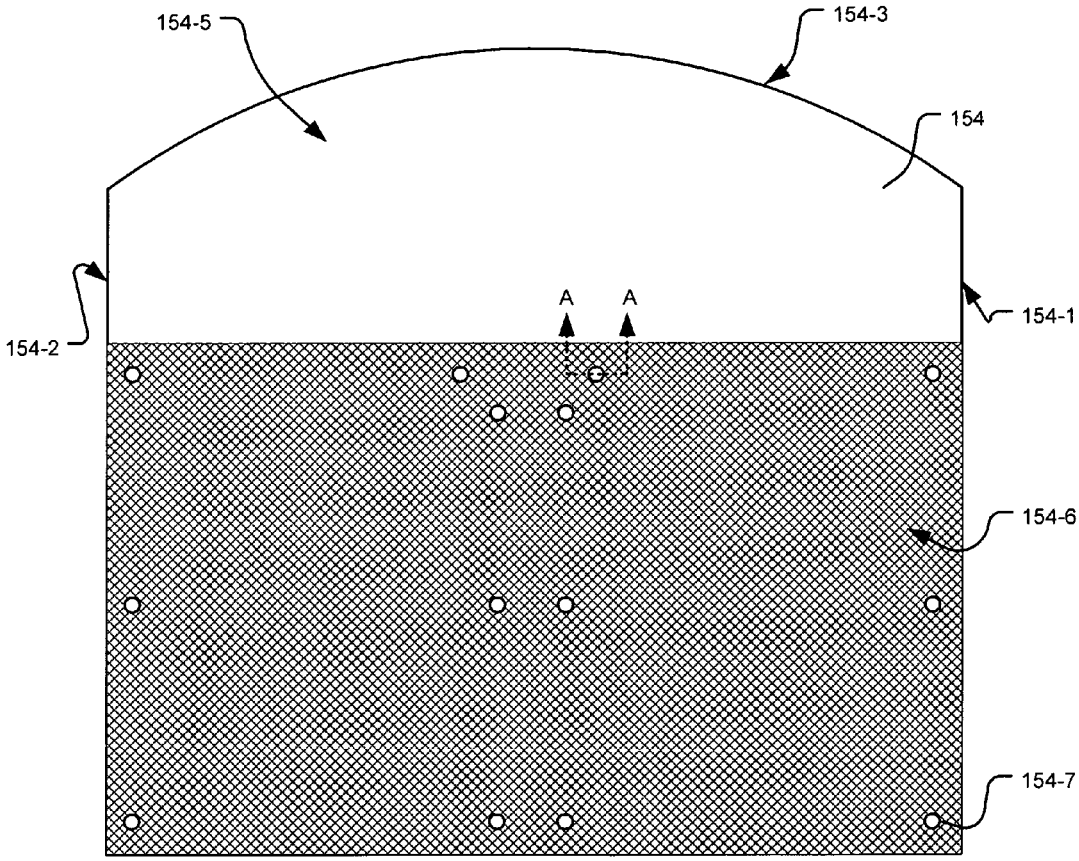
FIG. 4I shows an inner ground layer in the PCB of FIG. 4A.
Figure 4J:
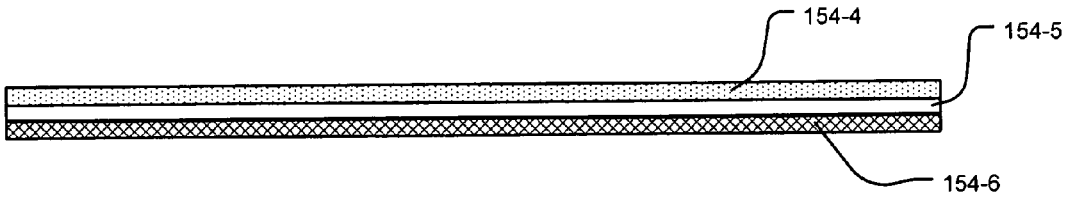
FIG. 4J is a cross-sectional view of the PCB of FIG. 4A showing different layers of the PCB.
Figure 4K:
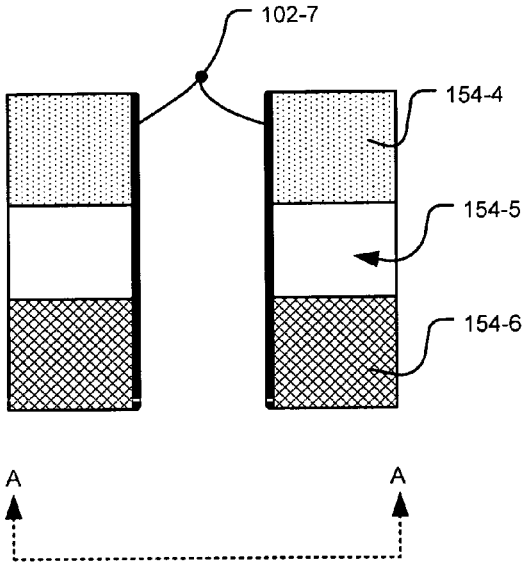
FIG. 4K is a cross-sectional view of a via-hole (i.e., a through-hole) in the PCB of FIG. 4A.

The dual band antenna 110-1 is printed on a top surface 154-5 of the PCB 154 as shown in FIG. 4A. The ring antennas 152 are mounted on the top surface 154-5. A layer of copper adjacent to the top surface 154-5 forms a top or an outer ground layer 154-4. Additionally, a layer of copper adjacent to a surface that is opposite to the top surface 154-5 forms a bottom or an inner ground layer 154-6 as shown in FIG. 4I. The top surface 154-5 separates and insulates the top ground layer 154-4 from the bottom ground layer 154-6 as shown in FIG. 4J. The top and bottom ground layers are connected by via-holes or through-holes 102-7 as shown in FIG. 4K. Although copper is shown as an example, other electrically conducting materials may be used. The inner ring 156 of each ring antenna 152 is connected to the top ground layer at locations identified by numbers 153-5 in FIG. 4A.

Figure 5:
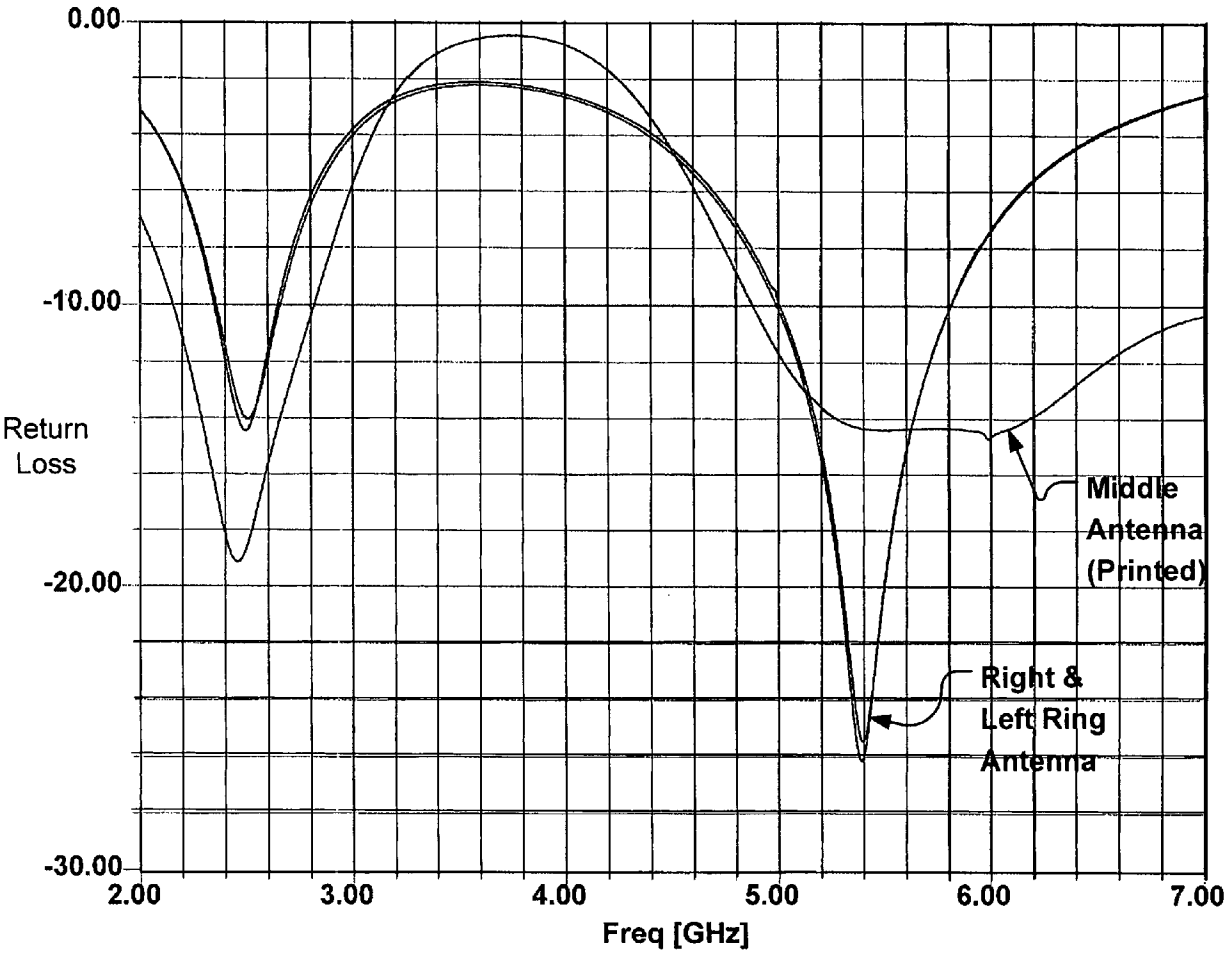
FIG. 5 is a graph of return loss versus frequency for the antennas in the antenna system of FIG. 4A according to the present disclosure.
Figure 6A:
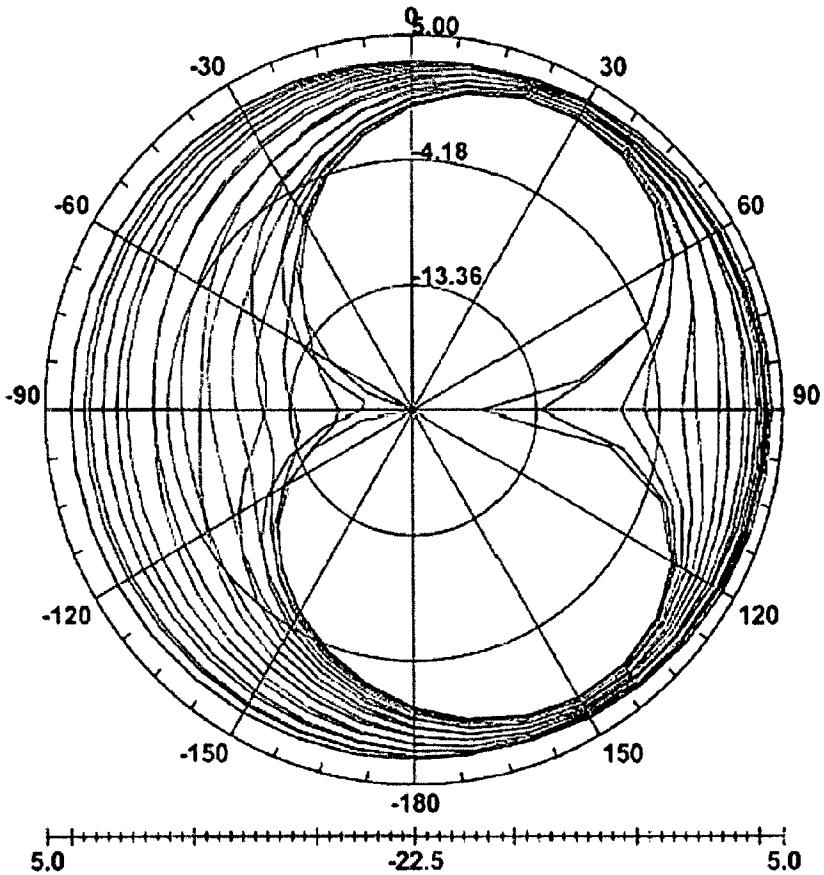
FIG. 6A shows a radiation pattern of the printed dual band antenna when communicating in 2.4 GHz frequency band in the antenna system of FIG. 4A according to the present disclosure.
Figure 6B:
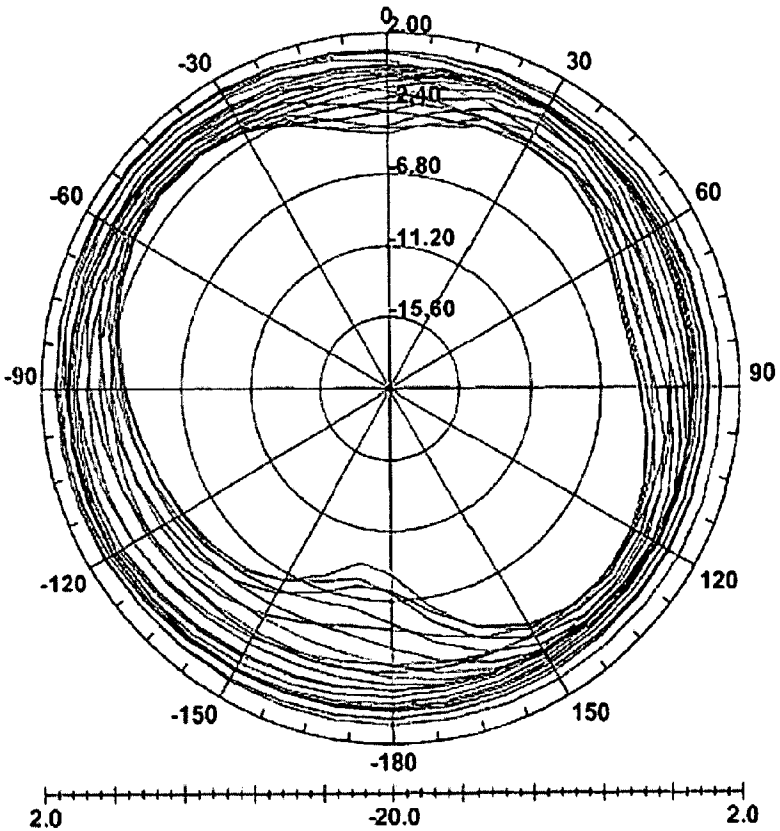
FIG. 6B shows a radiation pattern of the right ring antenna when communicating in 2.4 GHz frequency band in the antenna system of FIG. 4A according to the present disclosure.
Figure 6C:
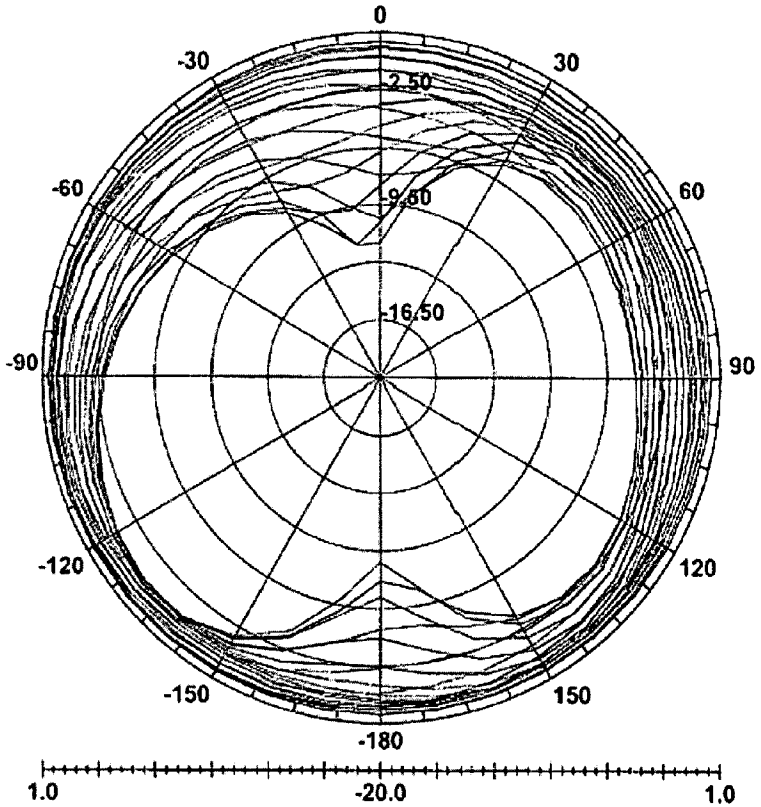
FIG. 6C shows a radiation pattern of the left ring antenna when communicating in 2.4 GHz frequency band in the antenna system of FIG. 4A according to the present disclosure.
Figure 7A:
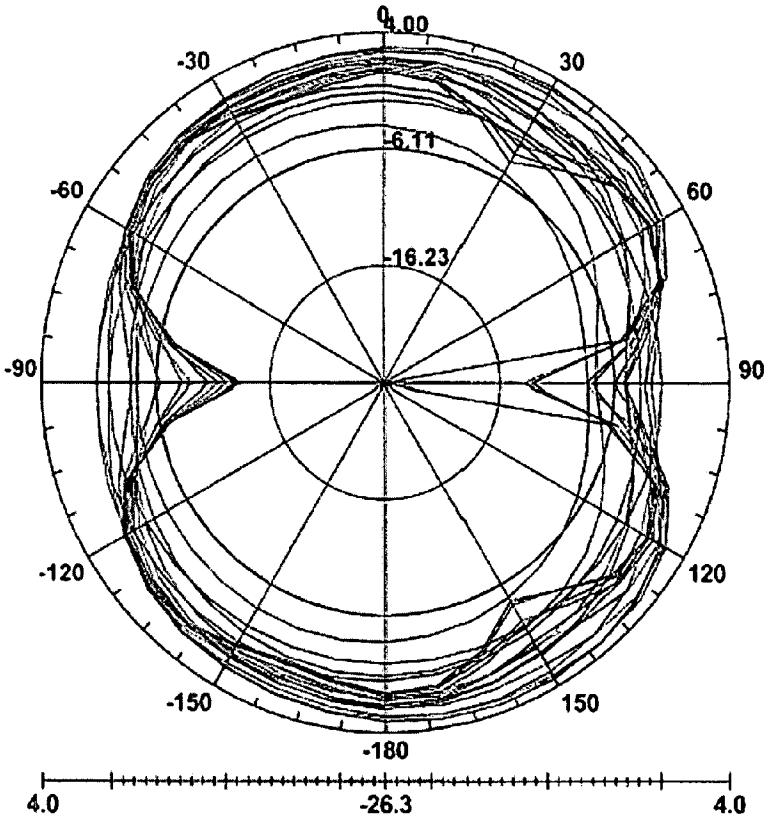
FIG. 7A shows a radiation pattern of the printed dual band antenna when communicating in 5 GHz frequency band in the antenna system of FIG. 4A according to the present disclosure.
Figure 7B:
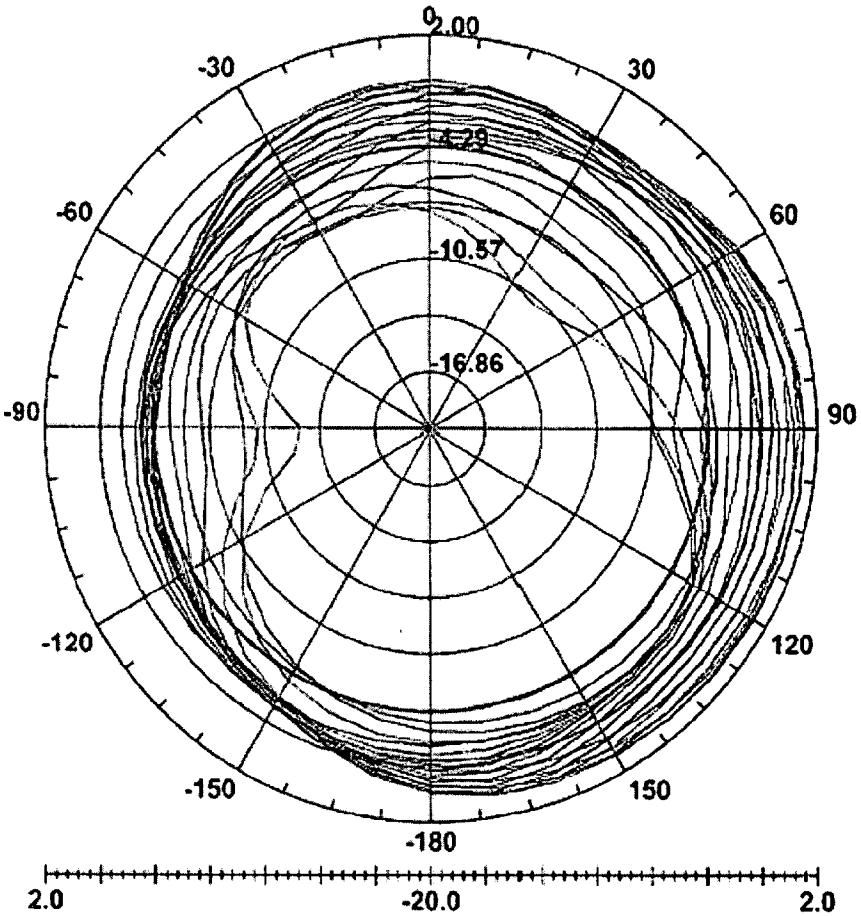
FIG. 7B shows a radiation pattern of the right ring antenna when communicating in 5 GHz frequency band in the antenna system of FIG. 4A according to the present disclosure.
Figure 7C:
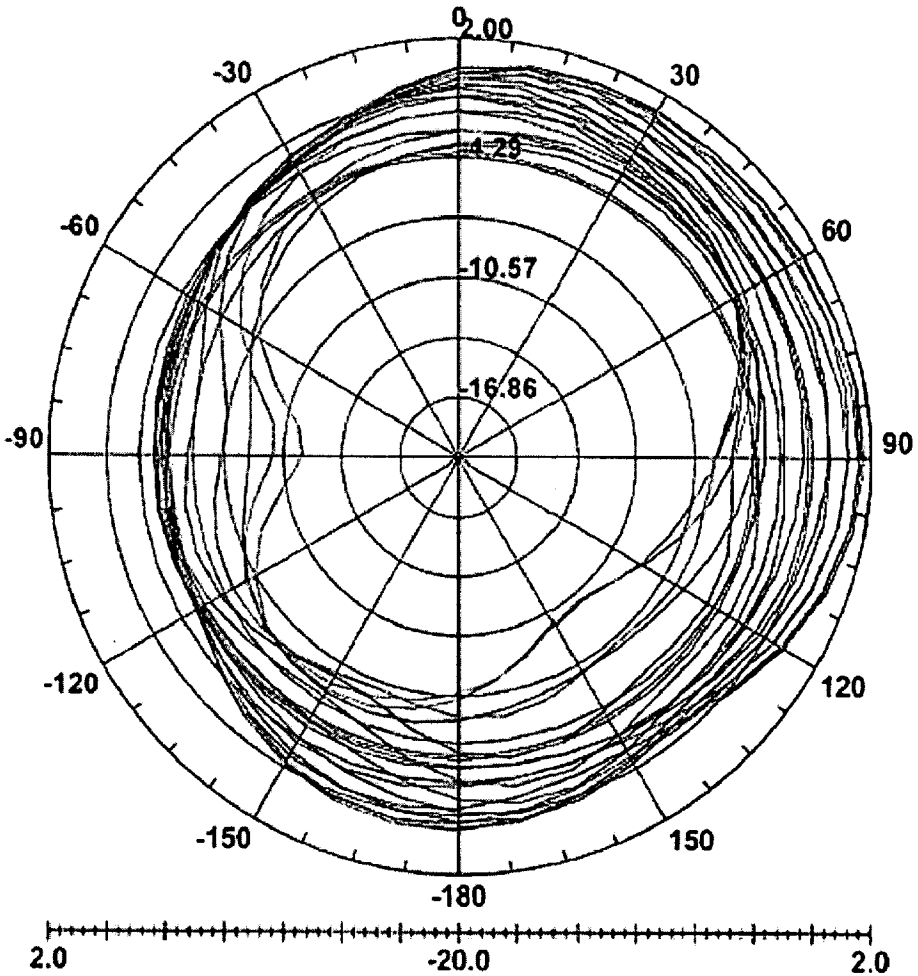
FIG. 7C shows a radiation pattern of the left ring antenna when communicating in 5 GHz frequency band in the antenna system of FIG. 4A according to the present disclosure.

FIG. 5 shows return losses of the dual band antenna 110-1, the first ring antenna 152-1, and the second ring antenna 152-2 when communicating in the antenna system 150. FIGS. 6A-6C show radiation patterns of the dual band antenna 110-1, the first ring antenna 152-1, and the second ring antenna 152-2, respectively, when communicating in the 2.4 GHz frequency band. FIGS. 7A-7C show radiation patterns of the dual band antenna 110-1, the first ring antenna 152-1, and the second ring antenna 152-2, respectively, when communicating in the 5 GHz frequency band.

Figure 8A:
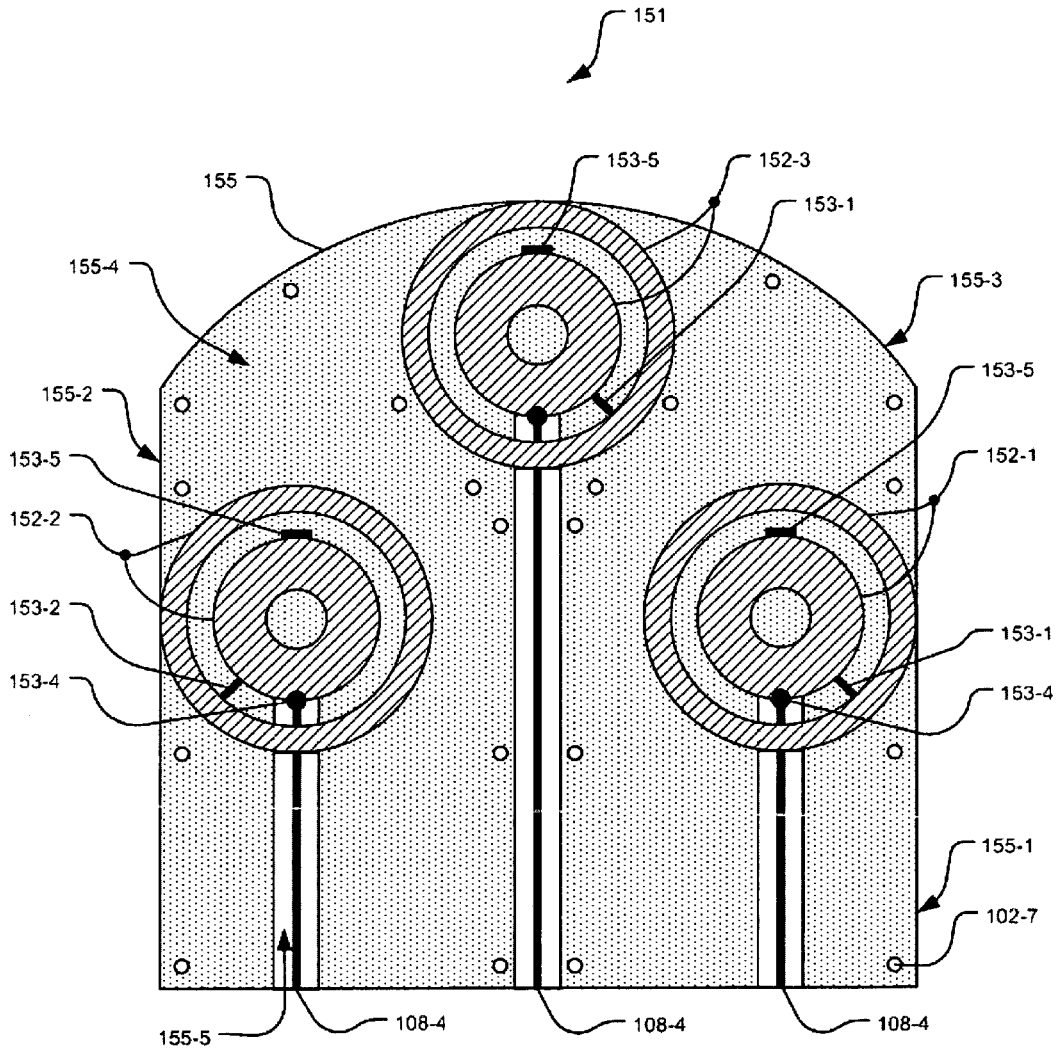
FIG. 8A shows an antenna system comprising three ring antennas mounted on a PCB according to the present disclosure.

Referring now to FIGS. 8A-8D, a 3×3 dual band antenna system 151 comprising ring antennas includes a first ring antenna 152-1, a second ring antenna 152-2, and a third ring antenna 152-3 (collectively ring antennas 152). The ring antennas 152 are dual band antennas and are arranged in a 3×3 MIMO configuration on a PCB 155 as shown in FIG. 8A. The ring antennas 152 are identical. The ring antennas 152 are identical to the ring antennas 152 in the 3×3 dual band antenna system 150.

The ring antennas 152 are not printed on the PCB 155. Instead, the ring antennas 152 are mounted on the PCB 155. The ring antennas 152 communicate in 2.4 GHz and 5 GHz frequency bands. The ring antennas 152 are connected to respective RF transceivers (not shown) by electrical connections 108-4. The electrical connections 108-4 are connected to the ring antennas 152 at locations identified by numbers 153-4. The electrical connections 108-4 may or may not be etched on the PCB 155. The electrical connections 108-4 may comprise insulated conductors.

The ring antennas 152 are located on the PCB 155 as follows. Centers of the ring antennas 152 form vertices of a triangle. The triangle may be an isosceles or an equilateral triangle. The first ring antenna 152-1 is located adjacent to an edge 155-1 of the PCB 155. The second ring antenna 152-2 is located adjacent to an edge 155-2 of the PCB 155. The edge 155-1 is parallel to the edge 155-2.

The third ring antenna 152-3 is identical to the ring antennas 152-1 and 152-2. The third ring antenna 152-3 is located adjacent to a third edge 155-3 of the PCB 155. A tangent drawn (not shown) to the edge 155-3 is perpendicular to edges 155-1 and 155-2. The tangent is parallel to a line joining the center of the first ring antenna 152-1 and the center of the second ring antenna 152-2.

Figure 8B:
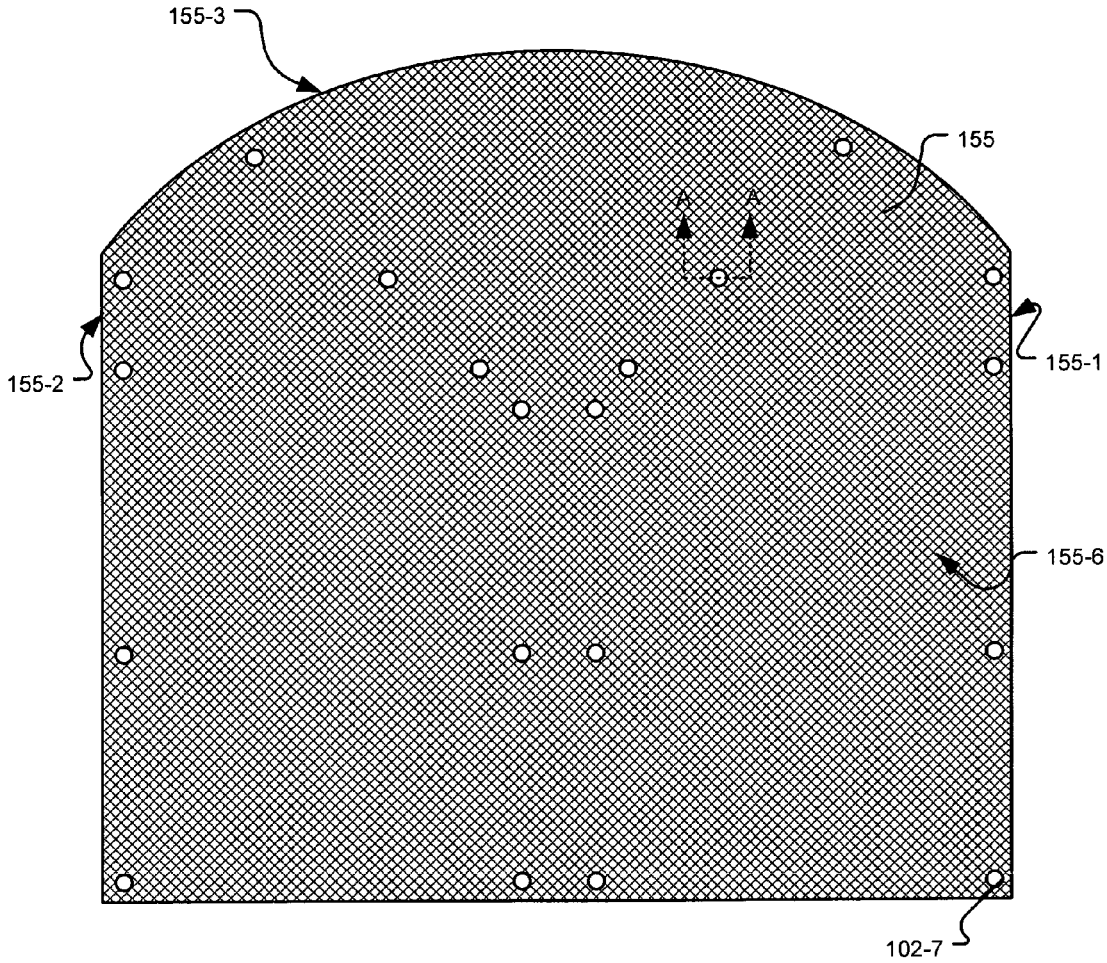
FIG. 8B shows an inner ground layer in the PCB of FIG. 8A.
Figure 8C:
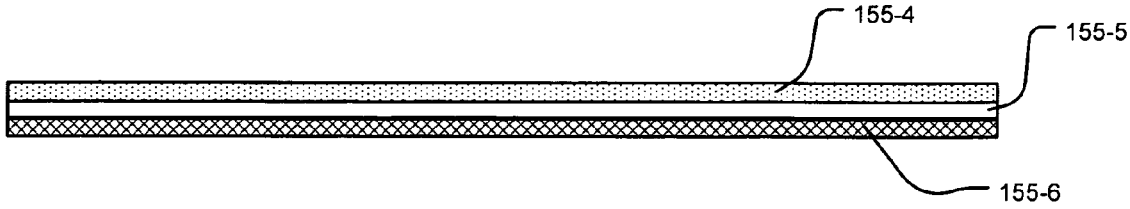
FIG. 8C is a cross-sectional view of the PCB of FIG. 8A showing different layers of the PCB.
Figure 8D:
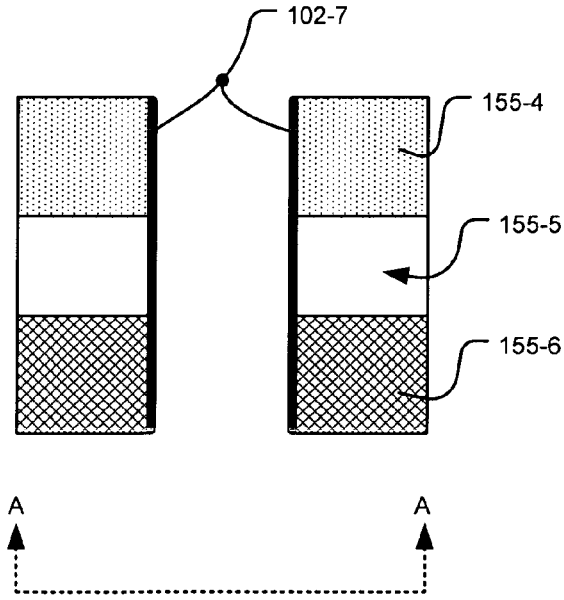
FIG. 8D is a cross-sectional view of a via-hole (i.e., a through-hole) in the PCB of FIG. 8A.

The ring antennas 152 are mounted on a top surface 155-5 of the PCB 155 as shown in FIG. 8A. A layer of copper adjacent to the top surface 155-5 forms a top or an outer ground layer 155-4. Additionally, a layer of copper adjacent to a surface that is opposite to the top surface 155-5 forms a bottom or an inner ground layer 155-6 as shown in FIG. 8B. The top surface 155-5 separates and insulates the top ground layer 155-4 from the bottom ground layer 155-6 as shown in FIG. 8C. The top and bottom ground layers are connected by via-holes or through-holes 102-7 as shown in FIG. 8D. Although copper is shown as an example, other electrically conducting materials may be used. The inner ring 156 of each ring antenna 152 is connected to the top ground layer at locations identified by numbers 153-5 in FIG. 8A.

Referring now to FIGS. 9A-9D, a 4×4 dual band antenna system 160 comprising two ring antennas is shown. The antenna system 160 includes a first dual band antenna 111-1 and a second dual band antenna 111-2 (collectively dual band antennas 111). Additionally, the antenna system 160 includes a first ring antenna 152-1 and a second ring antenna 152-2 (collectively ring antennas 152). The ring antennas 152 are also dual band antennas.

The dual band antennas 111 and the ring antennas 152 are arranged in a 4×4 MIMO configuration on a PCB 161. The dual band antennas 111 are printed on the PCB 161. The ring antennas 152 are not printed on the PCB 161. Instead, the ring antennas 152 are mounted on the PCB 161. Printing and mounting is indicated by two different shading patterns.

The dual band antennas 111 are identical and communicate in 2.4 GHz and 5 GHz frequency bands. The elements and components of the dual band antennas 111 are identical to the elements and components of the dual band antenna 110-1 in the 3×3 dual band antenna system 101. The dual band antennas 111 are connected to respective RF transceivers (not shown) by electrical connections 108-3. The electrical connections 108-3 are etched on the PCB 161.

The ring antennas 152 are identical and communicate in 2.4 GHz and 5 GHz frequency bands. The ring antennas 152 are identical to the ring antennas 152 in the 3×3 dual band antenna system 150. The ring antennas 152 are connected to respective RF transceivers (not shown) by electrical connections 108-4. The electrical connections 108-4 are connected to the ring antennas 152 at locations identified by numbers 153-4. The electrical connections 108-4 may or may not be etched on the PCB 161. The electrical connections 108-4 may comprise insulated conductors.

The dual band antennas 111 are located on the PCB 161 as follows. The convex sides 106-1 of the dual band antennas 111 are adjacent to an edge 161-3 of the PCB 161. The conducting elements 108 of the dual band antennas 111 are parallel.

The ring antennas 152 are located on the PCB 161 as follows. The first ring antenna 152-1 is adjacent to edge 161-1 of the PCB 161. The second ring antenna 152-2 is adjacent to edge 161-2 of the PCB 161. Edges 161-1 and 161-2 are parallel. Edge 161-3 is perpendicular to edges 161-1 and 161-2.

A line joining centers of the ring antennas 152 is perpendicular to the conducting elements 108 of the dual band antennas 111 and parallel to tangents drawn (not shown) at centers of the convex sides 106-1 of the dual band antennas 111. A line joining the center of the convex side 106-1 of the first dual band antenna 111-1 and the center of the first ring antenna 152-1 is parallel to a line joining the center of the convex side 106-1 of the second dual band antenna 111-2 and the center of the second ring antenna 152-2. Centers of the convex sides 106-1 (or concave sides 106-2) and centers of the ring antennas 152 form a rectangle when joined by straight lines (not shown).

Figure 9A:
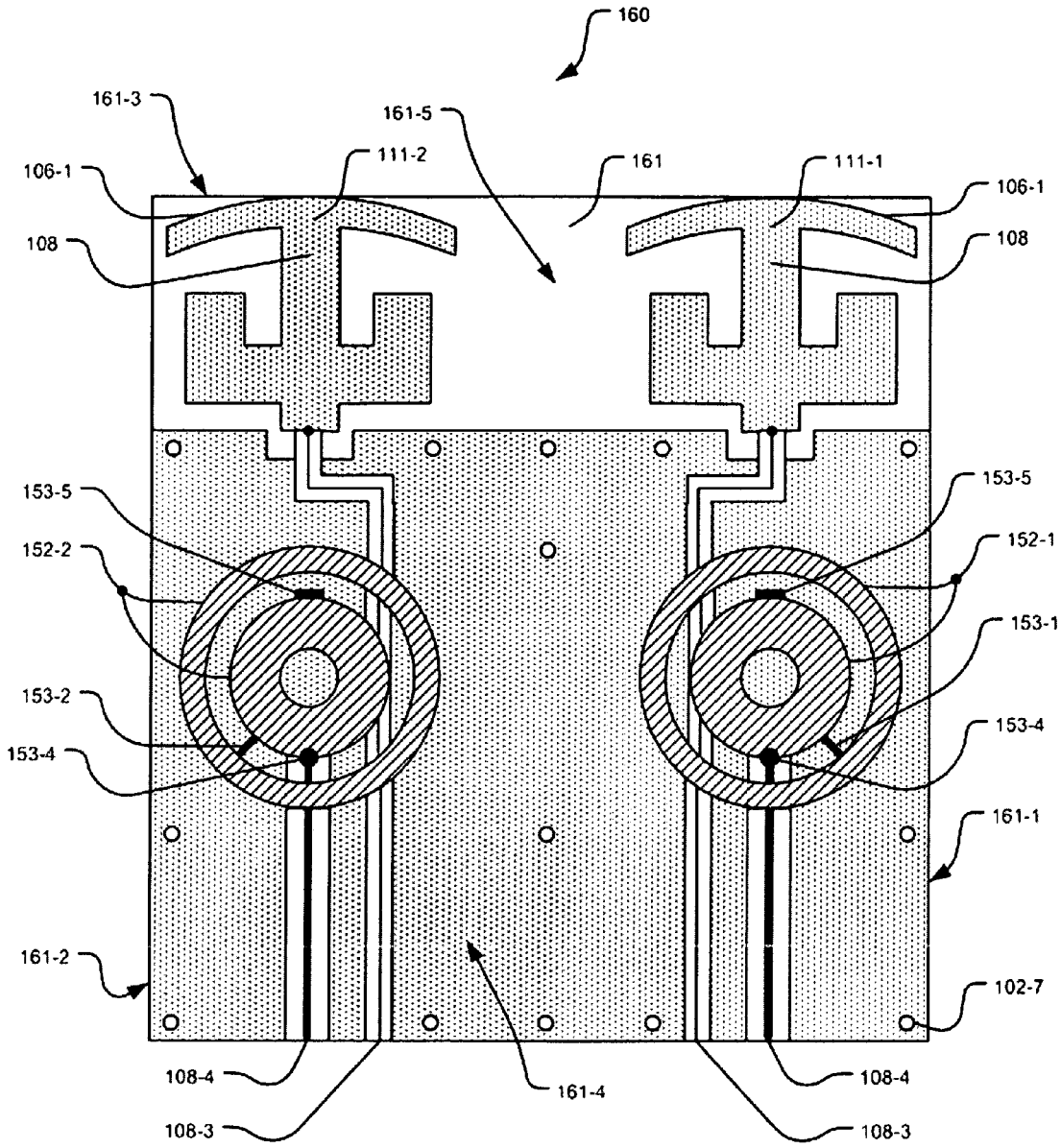
FIG. 9A shows an antenna system comprising two dual band antennas printed on a PCB and two ring antennas mounted on the PCB according to the present disclosure.
Figure 9B:
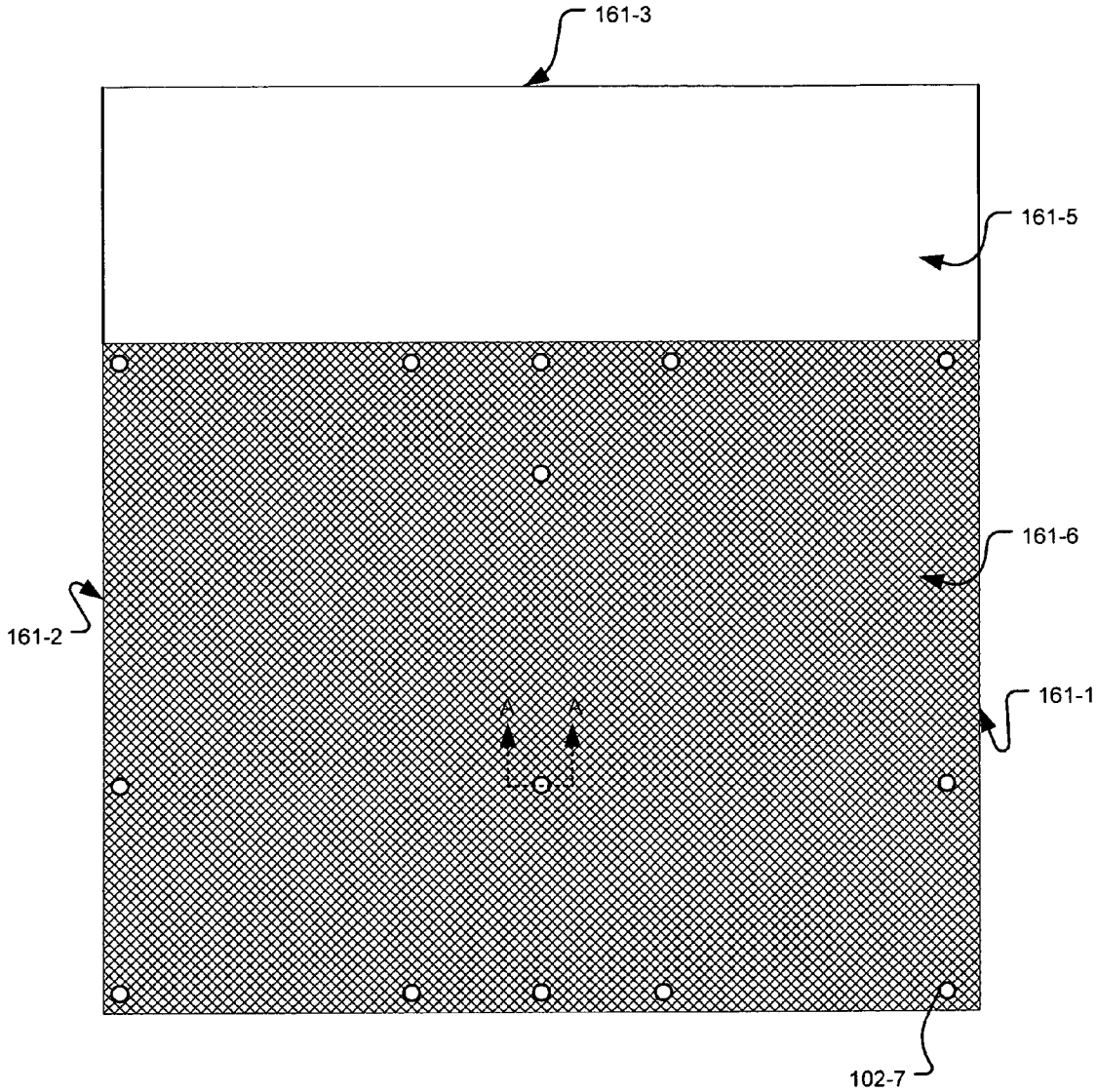
FIG. 9B shows an inner ground layer in the PCB of FIG. 9A.
Figure 9C:
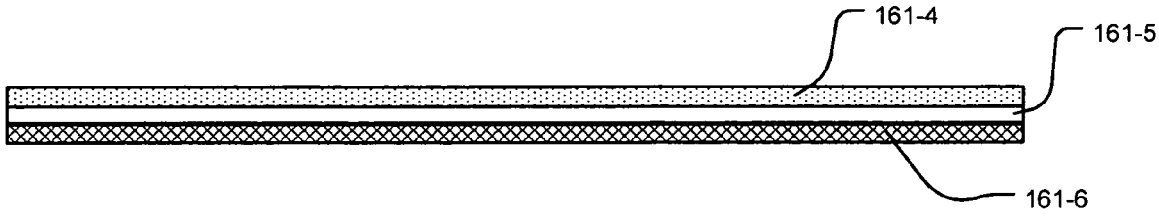
FIG. 9C is a cross-sectional view of the PCB of FIG. 9A showing different layers of the PCB.
Figure 9D:
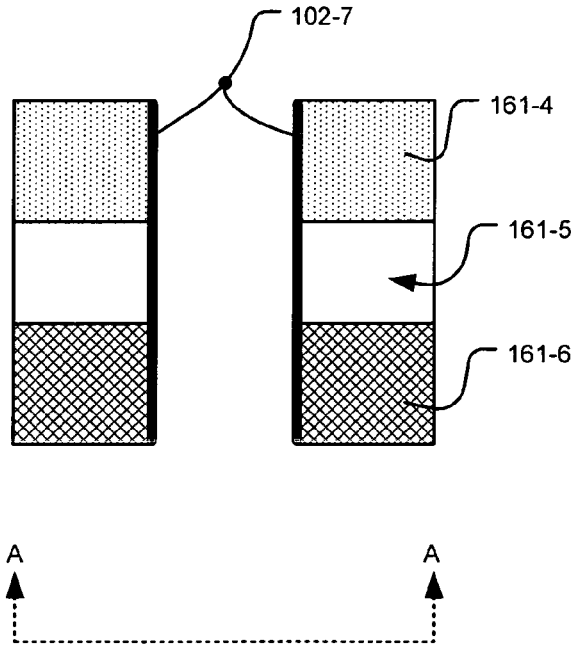
FIG. 9D is a cross-sectional view of a via-hole (i.e., a through-hole) in the PCB of FIG. 9A.

The dual band antennas 111 are printed on a top surface 161-5 of the PCB 161 as shown in FIG. 9A. The ring antennas 152 are mounted on the top surface 161-5. A layer of copper on the top surface 161-5 forms a top or an outer ground layer 161-4. Additionally, a layer of copper adjacent to a surface that is opposite to the top surface 161-5 forms a bottom or an inner ground layer 161-6 as shown in FIG. 9B. The top surface 161-5 separates and insulates the top ground layer 161-4 from the bottom ground layer 161-6 as shown in FIG. 9C. The top and bottom ground layers are connected by via-holes or through-holes 102-7 as shown in FIG. 9D. Although copper is shown as an example, other electrically conducting materials may be used. The inner ring 156 of each ring antenna 152 is connected to the top ground layer at locations identified by numbers 153-5 in FIG. 9A.

The dual band antenna systems 101, 150, 151, and 160 (hereinafter dual band antenna systems) may be implemented on PCBs of client cards of network devices. Specifically, the dual band antenna systems may be implemented on PCBs used in access points and client stations.

The dual band antenna systems may be implemented in devices that are compliant with the Worldwide Interoperability for Microwave Access (WiMAX) standard. Additionally, the dual band antenna systems may be implemented in devices that operate in wireless fidelity networks and in cellular phones.

Figure 10A:
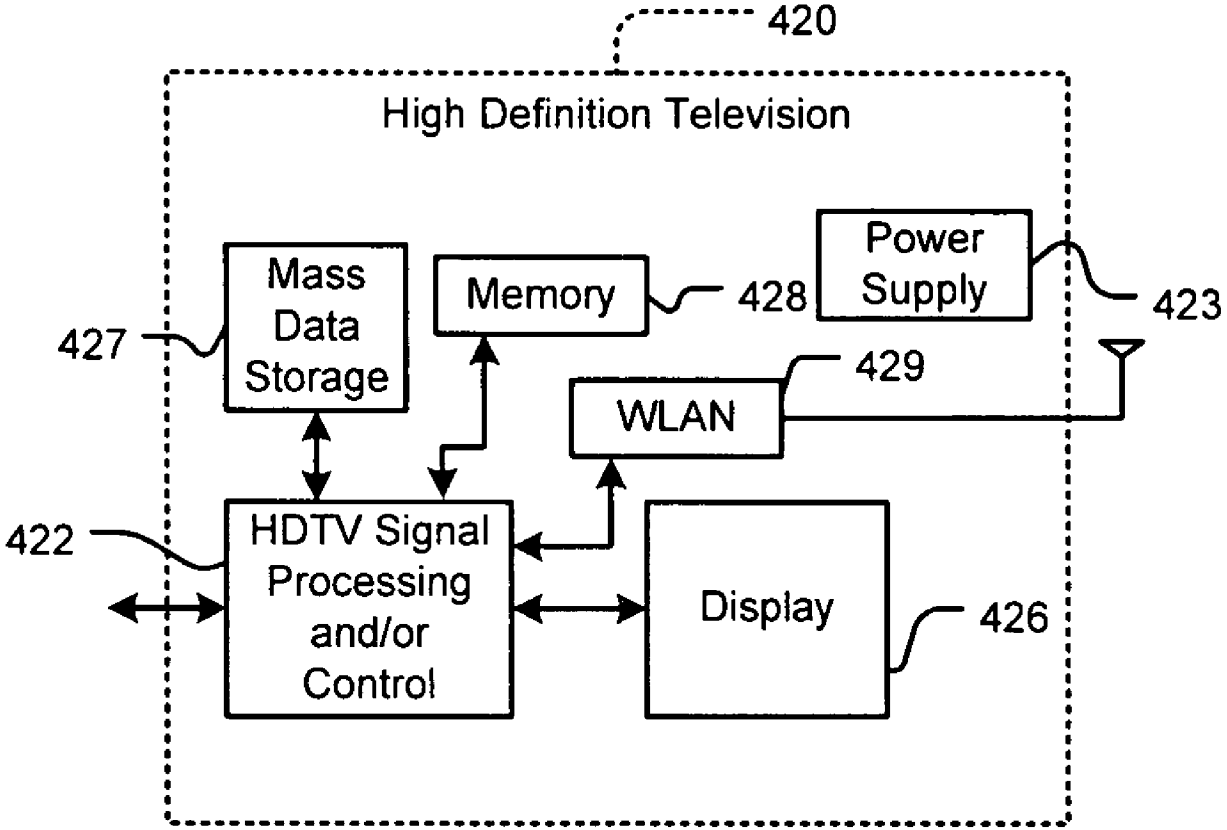
FIG. 10A is a functional block diagram of a high definition television.

Referring now to FIGS. 10A-10E, various exemplary implementations of the dual band antenna systems are shown. Referring now to FIG. 10A, the dual band antenna systems can be implemented in a WLAN interface 429 in a high definition television (HDTV) 420. The HDTV 420 receives HDTV input signals in either a wired or wireless format and generates HDTV output signals for a display 426. In some implementations, signal processing circuit and/or control circuit 422 and/or other circuits (not shown) of the HDTV 420 may process data, perform coding and/or encryption, perform calculations, format data and/or perform any other type of HDTV processing that may be required.

The HDTV 420 may communicate with mass data storage 427 that stores data in a nonvolatile manner such as optical and/or magnetic storage devices including hard disk drives (HDDs) and digital versatile disk (DVD) drives. The HDD may be a mini HDD that includes one or more platters having a diameter that is smaller than approximately 1.8". The HDTV 420 may be connected to memory 428 such as RAM, ROM, low latency nonvolatile memory such as flash memory and/or other suitable electronic data storage. The HDTV 420 also may support connections with a WLAN via the WLAN interface 429.

Figure 10C:
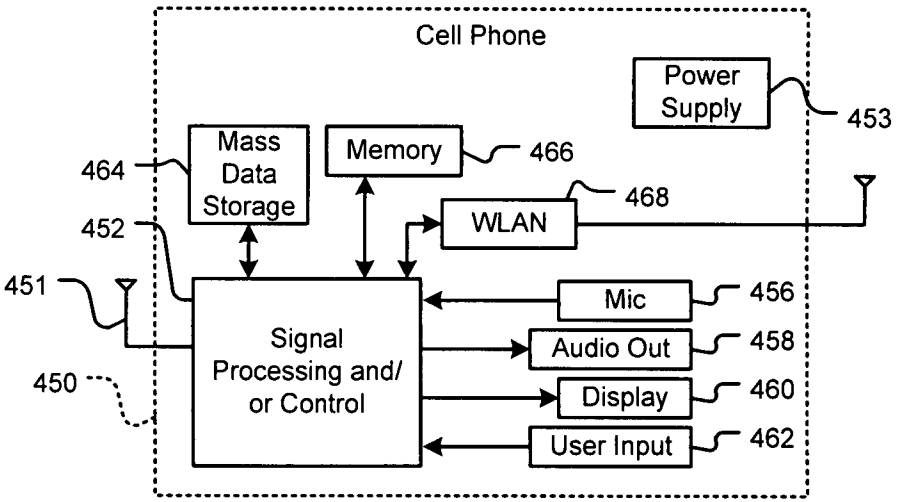
FIG. 10C is a functional block diagram of a cellular phone.
Figure 10B:
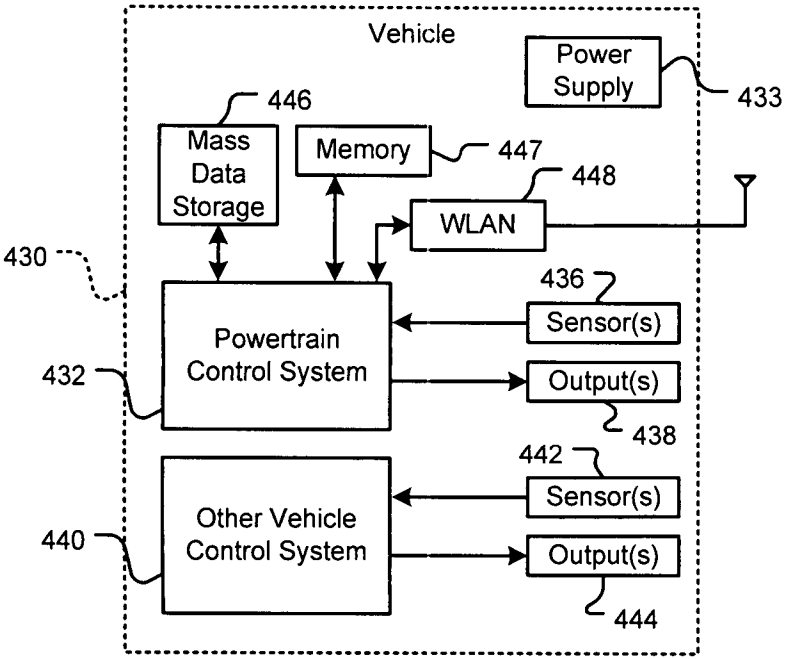
FIG. 10B is a functional block diagram of a vehicle control system.

Referring now to FIG. 10B, the dual band antenna systems may be implemented in a WLAN interface 448 in a control system of a vehicle 430. In some implementations, a powertrain control system 432 receives inputs from one or more sensors such as temperature sensors, pressure sensors, rotational sensors, airflow sensors and/or any other suitable sensors and/or generates one or more output control signals such as engine operating parameters, transmission operating parameters, and/or other control signals.

The control system 440 may likewise receive signals from input sensors 442 and/or output control signals to one or more output devices 444. In some implementations, the control system 440 may be part of an anti-lock braking system (ABS), a navigation system, a telematics system, a vehicle telematics system, a lane departure system, an adaptive cruise control system, a vehicle entertainment system such as a stereo, DVD, compact disc and the like. Still other implementations are contemplated.

The powertrain control system 432 may communicate with mass data storage 446 that stores data in a nonvolatile manner. The mass data storage 446 may include optical and/or magnetic storage devices such as hard disk drives (HDDs) and/or DVD drives. The HDD may be a mini HDD that includes one or more platters having a diameter that is smaller than approximately 1.8". The powertrain control system 432 may be connected to memory 447 such as RAM, ROM, low latency nonvolatile memory such as flash memory and/or other suitable electronic data storage. The powertrain control system 432 also may support connections with a WLAN via the WLAN interface 448. The control system 440 may also include mass data storage, memory and/or a WLAN interface (all not shown).

Referring now to FIG. 10C, the dual band antenna systems can be implemented in a WLAN interface 468 of a cellular phone 450 that may include a cellular antenna 451. In some implementations, the cellular phone 450 includes a microphone 456, an audio output 458 such as a speaker and/or audio output jack, a display 460 and/or an input device 462 such as a keypad, pointing device, voice actuation and/or other input device. The signal processing and/or control circuits 452 and/or other circuits (not shown) in the cellular phone 450 may process data, perform coding and/or encryption, perform calculations, format data and/or perform other cellular phone functions.

The cellular phone 450 may communicate with mass data storage 464 that stores data in a nonvolatile manner such as optical and/or magnetic storage devices such as hard disk drives (HDDs) and/or DVD drives. The HDD may be a mini HDD that includes one or more platters having a diameter that is smaller than approximately 1.8". The cellular phone 450 may be connected to memory 466 such as RAM, ROM, low latency nonvolatile memory such as flash memory and/or other suitable electronic data storage. The cellular phone 450 also may support connections with a WLAN via the WLAN interface 468.

Figure 10D:
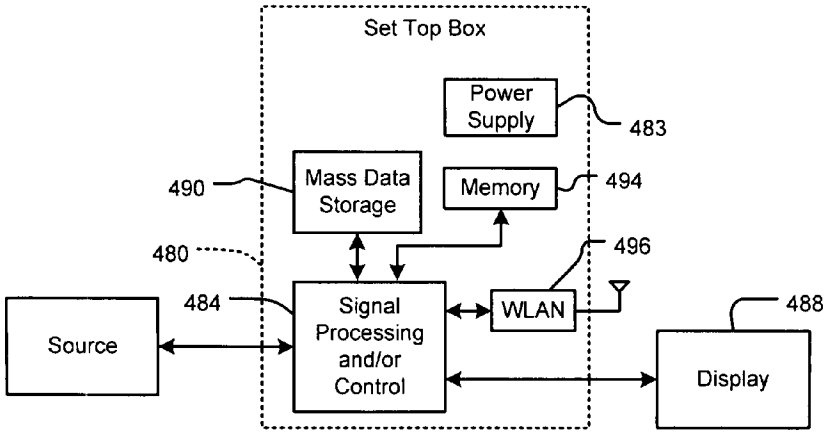
FIG. 10D is a functional block diagram of a set top box.

Referring now to FIG. 10D, the dual band antenna systems can be implemented in a WLAN interface 496 of a set top box 480. The set top box 480 receives signals from a source such as a broadband source and outputs standard and/or high definition audio/video signals suitable for a display 488 such as a television and/or a monitor and/or other video and/or audio output devices. The signal processing and/or control circuits 484 and/or other circuits (not shown) of the set top box 480 may process data, perform coding and/or encryption, perform calculations, format data and/or perform any other set top box function.

The set top box 480 may communicate with mass data storage 490 that stores data in a nonvolatile manner. The mass data storage 490 may include optical and/or magnetic storage devices such as hard disk drives (HDDs) and/or DVD drives. The HDD may be a mini HDD that includes one or more platters having a diameter that is smaller than approximately 1.8". The set top box 480 may be connected to memory 494 such as RAM, ROM, low latency nonvolatile memory such as flash memory and/or other suitable electronic data storage. The set top box 480 also may support connections with a WLAN via the WLAN interface 496.

Figure 10E:
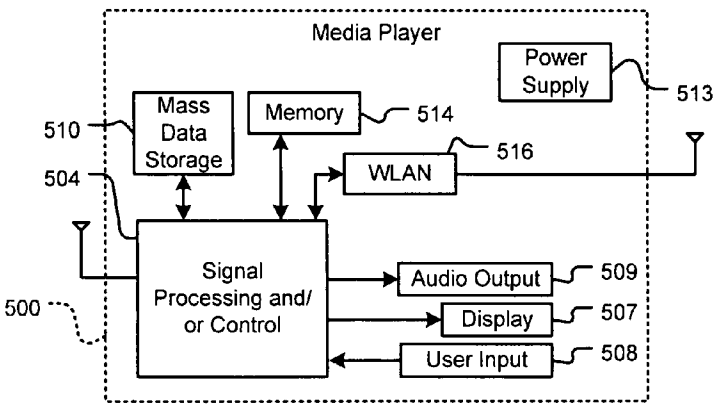
FIG. 10E is a functional block diagram of a media player.

Referring now to FIG. 10E, the dual band antenna systems can be implemented in a WLAN interface 516 of a media player 500. In some implementations, the media player 500 includes a display 507 and/or a user input 508 such as a keypad, touchpad and the like. In some implementations, the media player 500 may employ a graphical user interface (GUI) that typically employs menus, drop down menus, icons and/or a point-and-click interface via the display 507 and/or user input 508. The media player 500 further includes an audio output 509 such as a speaker and/or audio output jack. The signal processing and/or control circuits 504 and/or other circuits (not shown) of the media player 500 may process data, perform coding and/or encryption, perform calculations, format data and/or perform any other media player function.

The media player 500 may communicate with mass data storage 510 that stores data such as compressed audio and/or video content in a nonvolatile manner. In some implementations, the compressed audio files include files that are compliant with MP3 format or other suitable compressed audio and/or video formats. The mass data storage may include optical and/or magnetic storage devices such as hard disk drives (HDDs) and/or DVD drives. The HDD may be a mini HDD that includes one or more platters having a diameter that is smaller than approximately 1.8". The media player 500 may be connected to memory 514 such as RAM, ROM, low latency nonvolatile memory such as flash memory and/or other suitable electronic data storage. The media player 500 also may support connections with a WLAN via the WLAN interface 516. Still other implementations in addition to those described above are contemplated.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. An antenna system, comprising:

a first antenna that is arranged on a printed circuit board (PCB) and that includes:

an arc-shaped element having a concave side and a convex side;

a conducting element that extends substantially radially from a center of said concave side; and a U-shaped element having a base portion with a center that communicates with said conducting element and two side portions that extend from ends of said base portion towards said concave side; and second and third antennas that are arranged on said PCB and that include an inner ring and an outer ring that is concentric to said inner ring.

2. The antenna system of claim 1 wherein said two side portions and said conducting element are substantially parallel to each other and substantially perpendicular to said base portion.

3. The antenna system of claim 1 wherein said inner ring has a greater ring width than said outer ring, and wherein said ring width is a radial distance between an inner circumference and an outer circumference of each of said inner ring and said outer ring.

4. The antenna system of claim 1 wherein said inner ring communicates with said outer ring.

5. The antenna system of claim 1 wherein:

said concave side faces said second and third antennas;

said center of said concave side and centers of said inner and outer rings of said second and third antennas constitute vertices of a triangle;

said conducting element is substantially perpendicular to a line joining said centers; and said conducting element extends towards a mid-point of said line.

6. The antenna system of claim 5 wherein said triangle is one of an isosceles triangle and an equilateral triangle.

7. The antenna system of claim 1 wherein said convex side radiates electromagnetic radiation and said U-shaped element directs said electromagnetic radiation.

8. The antenna system of claim 1 wherein said first, second, and third antennas communicate in a dual frequency band in a 3×3 multiple input multiple output (MIMO) configuration.

9. The antenna system of claim 1 wherein said first, second, and third antennas communicate in 2.4 GHz and 5 GHz frequency bands in a 3×3 multiple input multiple output (MIMO) configuration.

10. The antenna system of claim 1 wherein said arc-shaped element communicates in a 2.4 GHz frequency band and said U-shaped element communicates in a 5 GHz frequency band.

11. The antenna system of claim 1 wherein said inner ring communicates in a 5 GHz frequency band and said outer ring communicates in a 2.4 GHz frequency band.

12. The antenna system of claim 1 wherein said first antenna is printed on said PCB.

13. The antenna system of claim 1 wherein said second and third antennas are mounted on said PCB.

14. The antenna system of claim 1 wherein said conducting element of said first antenna communicates with a radio frequency (RF) transceiver.

15. The antenna system of claim 1 wherein said second and third antennas communicate with respective radio frequency (RF) transceivers.

16. The antenna system of claim 1 wherein said PCB comprises a first electrically conducting layer that is adjacent to a first surface of said PCB and a second electrically conducting layer that is adjacent to a second surface of said PCB, and wherein said first surface is opposite to said second surface.

17. The antenna system of claim 16 wherein said first electrically conducting layer and said first antenna are printed on said first surface, and wherein said first electrically conducting layer is not joined to said first antenna.

18. The antenna system of claim 16 wherein said second and third antennas are mounted on said first electrically conducting layer, and wherein said inner rings of said second and third antennas communicate with said first electrically conducting layer.

19. The antenna system of claim 16 wherein said first electrically conducting layer communicates with said second electrically conducting layer via through-holes.

20. The antenna system of claim 16 wherein said first and second electrically conducting layers include copper.

21. A wireless network device comprising the antenna system of claim 1.

22. A device comprising the antenna system of claim 1 wherein the device is compliant with Worldwide Interoperability for Microwave Access (WiMAX) standard.

23. A wireless network device comprising the antenna system of claim 1 wherein the wireless network device operates in a wireless fidelity local area network and complies with at least one of IEEE 802.11a, 802.11b, 802.11g, 802.11n, and 802.16 standards.

24. A cellular phone comprising the antenna system of claim 1.

25. A method, comprising:

arranging an arc-shaped element of a first antenna on a printed circuit board (PCB), wherein said arc-shaped element has a concave side and a convex side;

extending a conducting element of said first antenna substantially radially from a center of said concave side on said PCB;

arranging a base portion of a U-shaped element of said first antenna on said PCB;

communicating between a center of said base portion and said conducting element;

extending two side portions of said U-shaped element from ends of said base portion towards said concave side; and arranging an inner ring of each of second and third antennas concentrically with an outer ring of each of said second and third antennas on said PCB, respectively.

26. The method of claim 25 further comprising arranging said two side portions and said conducting element substantially parallel to each other and substantially perpendicular to said base portion on said PCB.

27. The method of claim 25 further comprising communicating between said inner and outer rings, wherein said inner ring has a greater ring width than said outer ring, and wherein said ring width is a radial distance between an inner circumference and an outer circumference of each of said inner ring and said outer ring.

28. The method of claim 25 further comprising:

arranging said concave side facing said second and third antennas;

arranging said center of said concave side and centers of said inner and outer rings of said second and third antennas at vertices of a triangle, wherein said triangle is one of an isosceles triangle and an equilateral triangle;

arranging said conducting element substantially perpendicular to a line joining said centers; and extending said conducting element towards a mid-point of said line.

29. The method of claim 25 further comprising radiating electromagnetic radiation from said convex side of said arc-shaped element and directing said electromagnetic radiation with said U-shaped element.

30. The method of claim 25 further comprising configuring said first, second, and third antennas in a 3×3 multiple input multiple output (MIMO) configuration and communicating in a dual frequency band.

31. The method of claim 25 further comprising configuring said first, second, and third antennas in a 3×3 multiple input multiple output (MIMO) configuration and communicating in 2.4 GHz and 5 GHz frequency bands.

32. The method of claim 25 further comprising communicating in a 2.4 GHz frequency band with said arc-shaped element and communicating in a 5 GHz frequency band with said U-shaped element.

33. The method of claim 25 further comprising communicating in a 2.4 GHz frequency band with said outer ring and communicating in a 5 GHz frequency band with said inner ring.

34. The method of claim 25 further comprising printing said first antenna on said PCB.

35. The method of claim 25 further comprising mounting said second and third antennas on said PCB.

36. The method of claim 25 further comprising communicating between said conducting element of said first antenna and a radio frequency (RF) transceivers.

37. The method of claim 25 further comprising communicating between said second and third antennas and respective radio frequency (RF) transceivers.

38. The method of claim 25 further comprising:

arranging a first electrically conducting layer adjacent to a first surface of said PCB;

arranging a second surface of said PCB opposite to said first surface; and arranging a second electrically conducting layer adjacent to a second surface of said PCB.

39. The method of claim 38 further comprising printing said first electrically conducting layer and said first antenna on said first surface, and not joining said first electrically conducting layer to said first antenna.

40. The method of claim 38 further comprising mounting said second and third antennas on said first electrically conducting layer, and communicating between said first electrically conducting layer and said inner rings of said second and third antennas.

41. The method of claim 38 further comprising communicating between said first and second electrically conducting layers.

42. The method of claim 38 further comprising providing copper in said first and second electrically conducting layers.

* * * * *

UNITED STATES PATENT AND TRADEMARK OFFICE

CERTIFICATE OF CORRECTION

PATENT NO. : 7,423,599 B2
APPLICATION NO. : 11/581540
DATED : September 9, 2008
INVENTOR(S) : James Li et al.

It is certified that error appears in the above-identified patent and that said Letters Patent is hereby corrected as shown below:

| | |
|---|---|
| Column 7, Line 59 | Delete “Instill” and insert -- In still -- |
| Column 13, Line 4 | Delete “and” and insert -- an -- |
| Column 25, Line 48 | Delete “1534” and insert -- 153-4 -- |

Signed and Sealed this

Sixth Day of January, 2009

JON W. DUDAS
*Director of the United States Patent and Trademark Office*